US009728148B2

(12) United States Patent
Miyata et al.

(10) Patent No.: US 9,728,148 B2
(45) Date of Patent: Aug. 8, 2017

(54) LIQUID CRYSTAL DISPLAY APPARATUS AND METHOD OF DRIVING THE LIQUID CRYSTAL DISPLAY APPARATUS

(71) Applicant: Sharp Kabushiki Kaisha, Sakai, Osaka (JP)

(72) Inventors: Hidekazu Miyata, Osaka (JP); Takao Imaoku, Osakai (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 14/893,125

(22) PCT Filed: Feb. 18, 2014

(86) PCT No.: PCT/JP2014/053692
§ 371 (c)(1),
(2) Date: Nov. 23, 2015

(87) PCT Pub. No.: WO2015/019636
PCT Pub. Date: Feb. 12, 2015

(65) Prior Publication Data

US 2016/0104444 A1 Apr. 14, 2016

(30) Foreign Application Priority Data

Aug. 8, 2013 (JP) ..... 2013-165076

(51) Int. Cl.
*G09G 3/36* (2006.01)
*G09G 3/34* (2006.01)

(52) U.S. Cl.
CPC ..... *G09G 3/3648* (2013.01); *G09G 3/3406* (2013.01); *G09G 3/3413* (2013.01); (Continued)

(58) Field of Classification Search
None
See application file for complete search history.

(56) References Cited

U.S. PATENT DOCUMENTS 6,492,969 B1 12/2002 Budzelaar
2006/0022926 A1* 2/2006 Mizumaki ..... G09G 3/3648 345/89

(Continued)

FOREIGN PATENT DOCUMENTS

JP H07-121138 A 5/1995
JP 2003-502687 A 1/2003

(Continued)

OTHER PUBLICATIONS

International Search Report PCT/ISA/210 for International Application No. PCT/JP2014/053692 dated Mar. 27, 2014.

(Continued)

*Primary Examiner* — Joseph Haley
(74) *Attorney, Agent, or Firm* — Harness, Dickey & Pierce, P.L.C.

(57) ABSTRACT

The color-field sequential liquid crystal display apparatus includes a liquid-crystal state value acquirer that acquires a liquid-crystal state value (a gradation value corresponding to the state of orientation of liquid crystal molecules) at the end of a displayed field on the basis of an input gradation value of the displayed field and the liquid-crystal state value at the end of a previous field (the first previous field of the displayed field) and an applied gradation value determiner that determines an applied gradation value of the displayed field by compensating the input gradation value of the displayed field on the basis of the liquid-crystal state value at the end of the previous field. The applied gradation value determiner determines the applied gradation value so that a display luminance in each field is a display luminance corresponding to the input gradation value.

10 Claims, 28 Drawing Sheets

(52) U.S. Cl.
CPC ..... *G09G 2300/0426* (2013.01); *G09G 2310/0235* (2013.01); *G09G 2310/08* (2013.01); *G09G 2320/0252* (2013.01); *G09G 2320/0285* (2013.01); *G09G 2340/16* (2013.01)

(56) References Cited

U.S. PATENT DOCUMENTS

| | | | | |
|---|---|---|---|---|
| 2007/0236444 | A1 | 10/2007 | Woo et al. | |
| 2009/0079682 | A1* | 3/2009 | Yamato | G09G 3/3406 345/89 |
| 2009/0079769 | A1* | 3/2009 | Iisaka | G09G 3/3648 345/693 |
| 2010/0053225 | A1 | 3/2010 | Furukawa et al. | |
| 2012/0293571 | A1 | 11/2012 | Gotoh | |
| 2013/0012062 | A1 | 1/2013 | Nugent | |
| 2014/0267964 | A1 | 9/2014 | Iyama et al. | |

FOREIGN PATENT DOCUMENTS

| | | | |
|---|---|---|---|
| JP | 2007279660 | A | 10/2007 |
| JP | 2010261985 | A | 11/2010 |
| WO | WO-2008096481 | A1 | 8/2008 |
| WO | WO-2010084619 | A1 | 7/2010 |
| WO | WO-2011104979 | A1 | 9/2011 |
| WO | WO-2013006668 | A1 | 1/2013 |
| WO | WO-2013054745 | A1 | 4/2013 |

OTHER PUBLICATIONS

Written Opinion of the International Searching Authority PCT/ISA/237 for International Application No. PCT/JP2014/053692 dated Mar. 27, 2014.

* cited by examiner

| GRADATION VALUE (8 bit) | LUMINANCE VALUE (cd/m$^2$) |
|---|---|
| 0 | 0.053 |
| 1 | 0.054 |
| 2 | 0.055 |
| ⋮ | ⋮ |
| 253 | 73.133 |
| 254 | 73.770 |
| 255 | 74.410 |

FIG. 13

| GRADATION VALUE (8 bit) | LUMINANCE VALUE (cd/m$^2$) |
|---|---|
| 0 | 0.179 |
| 1 | 0.180 |
| 2 | 0.185 |
| ⋮ | ⋮ |
| 253 | 246.024 |
| 254 | 248.167 |
| 255 | 250.320 |

FIG. 14

| GRADATION VALUE (8 bit) | LUMINANCE VALUE (cd/m$^2$) |
|---|---|
| 0 | 0.0181 |
| 1 | 0.0182 |
| 2 | 0.0186 |
| ⋮ | ⋮ |
| 253 | 24.836 |
| 254 | 25.052 |
| 255 | 25.270 |

FIG. 18

R1

| INPUT GRADATION VALUE | LUMINANCE VALUE |
|---|---|
| 0 | ···· |
| 1 | ···· |
| 2 | ···· |
| ⋮ | ⋮ |
| 182 | ···· |
| 183 | ···· K1 |
| 184 | ···· |
| ⋮ | ⋮ |
| 253 | ···· |
| 254 | ···· |
| 255 | ···· |

R2

| INPUT GRADATION VALUE | LUMINANCE VALUE |
|---|---|
| 0 | ···· |
| 1 | ···· |
| 2 | ···· |
| ⋮ | ⋮ |
| 182 | ···· |
| 183 | ···· K2 |
| 184 | ···· |
| ⋮ | ⋮ |
| 253 | ···· |
| 254 | ···· |
| 255 | ···· |

FIG. 20

INPUT GRADATION VALUE OF DISPLAYED FIELD

LIQUID-CRYSTAL STATE VALUE AT END OF PREVIOUS FIELD

| | 0 | 32 | 64 | 96 | 128 | 160 | 192 | 224 | 255 |
|---|---|---|---|---|---|---|---|---|---|
| 0 | 0 | 41 | 80 | 107 | 135 | 165 | 197 | 230 | 255 |
| 32 | 0 | 32 | 68 | 100 | 134 | 164 | 197 | 229 | 255 |
| 64 | 0 | 25 | 64 | 98 | 132 | 163 | 196 | 229 | 255 |
| 96 | 0 | 17 | 61 | 96 | 130 | 162 | 195 | 228 | 255 |
| 128 | 0 | 2 | 57 | 95 | 128 | 161 | 194 | 227 | 255 |
| 160 | 0 | 0 | 54 | 93 | 127 | 160 | 193 | 226 | 255 |
| 192 | 0 | 0 | 50 | 91 | 125 | 160 | 192 | 225 | 255 |
| 224 | 0 | 0 | 47 | 90 | 123 | 159 | 192 | 224 | 255 |
| 255 | 0 | 0 | 43 | 88 | 121 | 158 | 191 | 224 | 255 |

LIQUID CRYSTAL DISPLAY APPARATUS AND METHOD OF DRIVING THE LIQUID CRYSTAL DISPLAY APPARATUS

TECHNICAL FIELD

The present invention relates to a liquid crystal display apparatus. In particular, the present invention relates to a technology that suppresses an occurrence of color shift in a color-field sequential liquid crystal display apparatus.

BACKGROUND ART

In general, in liquid crystal display apparatuses that perform color display, one pixel is divided into three sub-pixels: a red pixel provided with a color filter that transmits red light, a green pixel provided with a color filter that transmits green light, and a blue pixel provided with a color filter that transmits blue light. Although the color filters provided in the three sub-pixels enable the color display, about two-thirds of backlight light with which the liquid crystal panels are irradiated are absorbed by the color filters. As a result, there is a problem in that the color filter type liquid crystal display apparatuses have low light use efficiency. Accordingly, color-field sequential liquid crystal display apparatuses that perform the color display without using the color filters attract attention.

In the common liquid crystal display apparatuses that adopt the field sequential method, one frame period during which one screen is displayed is divided into three fields. Although each field is also called a sub-frame, the term "field" is consistently used in the following description. For example, one frame period is divided into a field (red field) in which a red screen is displayed on the basis of red components of an input image signal, a field (green field) in which a green screen is displayed on the basis of green components of the input image signal, and a field (blue field) in which a blue screen is displayed on the basis of blue components of the input image signal. Displaying each primary color in the above manner causes a color image to be displayed in the liquid crystal panel. Since the color display is performed in the above manner, it is not necessary to provide the color filters in the color-field sequential liquid crystal display apparatuses. Accordingly, the light use efficiency of the color-field sequential liquid crystal display apparatuses is about three times higher than that of the color filter type liquid crystal display apparatuses. Consequently, the color-field sequential liquid crystal display apparatuses are appropriate for increase in luminance and reduction in power consumption.

In this description, a combination of the value of data about the red components, the value of data about the green components, and the value of data about the blue components is referred to as "an RGB combination." For example, "R=128, G=32, and B=255" is an example of one RGB combination. In this example, the value of data about the red components has a value of 128, the value of data about the green components has a value of 32, and the value of data about the blue components has a value of 255. The value of data is typically a gradation value.

In the liquid crystal display apparatuses, image display is performed by controlling the transmittance of each pixel with voltage (liquid crystal applied voltage). It takes several milliseconds from a time when writing of data into each pixel (application of the voltage) is started to a time when the transmittance at the pixel reaches a target transmittance. Accordingly, in the color-field sequential liquid crystal display apparatuses, a backlight of the corresponding color is switched from a turned-off state to a turned-on state after the liquid crystal responds in each field to some extent.

In the liquid crystal display apparatuses, sufficient image quality may not be achieved, for example, in display of a movie due to a low response speed of the liquid crystal. Accordingly, a driving method called overdrive driving (overshoot driving) has hitherto been adopted as a countermeasure against the low response speed of the liquid crystal. The overdrive driving is a driving method in which drive voltage that is higher than predetermined gradation voltage corresponding to the value of data about the input image signal of the current frame or drive voltage that is lower than the predetermined gradation voltage corresponding to the value of data about the input image signal of the current frame is supplied to the liquid crystal panel depending on a combination of the value of data about the input image signal of the first previous frame and the value of data about the input image signal of the current frame. In other words, in the overdrive driving, compensation is performed so as to enhance the temporal change (not the special change) of the value of data for the input image signal. Adopting such overdrive driving causes the liquid crystal to respond so that the transmittance substantially reaches a target value (target transmittance) in each field in the current color filter type liquid crystal display apparatuses.

The following Patent Literatures in Citation List are known in association with the invention in this description. PTL 1 discloses an invention related to a compensation operation of color impurity in a color sequential LCD image display apparatus. According to this invention, a signal of each color is compensated on the basis of a signal of a preceding color. For example, when the colors are displayed in the order of "blue, green, and red", the signal of green is compensated on the basis of the signal of blue. In addition, PTL 2 discloses an invention related to color reproducibility in a time-division color liquid crystal display apparatus. According to this invention, scanning timing of a time-division three-primary-color light emitting apparatus is delayed by an amount corresponding to an optical response speed of the liquid crystal and a non-light-emitting period corresponding to the optical response time of the liquid crystal is provided. In writing of data into each pixel, gamma correction is performed, which is based on a result of comparison between data about the previous field (the first previous field of the current field) and data about the current field.

CITATION LIST

Patent Literature

PTL 1: Japanese Unexamined Patent Application Publication (Translation of PCT Application) No. 2003-502687

PTL 2: Japanese Unexamined Patent Application Publication No. 7-121138

SUMMARY OF INVENTION

Technical Problem

As described above, in the current color filter type liquid crystal display apparatuses, the adoption of the overdrive driving causes the liquid crystal to respond so that the transmittance substantially reaches a target value in each field. Accordingly, the sufficient image quality is achieved. However, in the color-field sequential liquid crystal display apparatuses, the sufficient image quality is not achieved because of the following reasons even when the transmittance reaches a target value in each field through the overdrive driving. In the color-field sequential liquid crystal display apparatuses, although the backlight is switched from the turned-off state to the turned-on state during each field, as described above, the transmittance has not reached the target value at the start of the turning on of the backlight. Accordingly, the liquid crystal state (the state of orientation of liquid crystal molecules) is varied also during the turning on of the backlight. Consequently, one-to-one correspondence is not established between the liquid crystal state at the end of each field and the luminance actually displayed in each field (display luminance). As a result, it is not possible to preferably control the color balance (chromaticity) which is desirably displayed in each field in the overdrive driving in related art, thereby causing the color shift. As described above, in the color-field sequential liquid crystal display apparatuses, the sufficient image quality is not achieved even when the transmittance reaches a target value in each field through the overdrive driving.

A case will now be considered in which a color of an RGB combination "R=128, G=128, and B=32" is displayed in a liquid crystal display apparatus using gradation data in which each color has eight bits. Referring to FIG. 35 to FIG. 37, a period during which a red backlight is turned on is denoted by TR, a period during which a green backlight is turned on is denoted by TG, and a period during which a blue backlight is turned on is denoted by TB. Variation in liquid crystal state is represented by variation in gradation value in FIG. 35 to FIG. 37.

If the liquid crystal molecules have ideal response characteristics, that is, if the response time of the liquid crystal when the field is switched is constantly zero, the liquid crystal state is varied in a manner illustrated by a bold line 91 in FIG. 35 even when the overdrive driving is not adopted. At this time, the RGB combination of a display gradation value is "R=128, G=128, and B=32." However, the response time of the liquid crystal is not actually zero. Accordingly, when the overdrive driving is not adopted, the liquid crystal state is varied in a manner illustrated by a bold line 92 in FIG. 36. At this time, the RGB combination of an attained gradation value at the end of the red field, the green field, and the blue field is, for example, "R=102, G=120, and B=65." As described above, when the overdrive driving is not adopted, a desired attained gradation value is not achieved at the end of the respective fields. Since the liquid crystal state is varied also during the turning on of the backlight, the RGB combination of the display gradation value is, for example, "R=90, G=114, and B=81."

When the overdrive driving is adopted, the liquid crystal state is varied in a manner, for example, illustrated by a bold line 93 in FIG. 37. At this time, the RGB combination of the attained gradation value at the end of the red field, the green field, and the blue field is "R=128, G=128, and B=32." The liquid crystal responds in the above manner so as to achieve the desired attained gradation value at the end of the respective fields. However, since the liquid crystal state is varied also during the turning on of the backlight, as described above, a desired display luminance is not achieved. The RGB combination of the display gradation value is, for example, "R=99, G=128, and B=60." The color shift occurs in the above manner in the color-field sequential liquid crystal display apparatus even when the overdrive driving is adopted.

In order to resolve the above problems, an object of the present invention is to realize a color-field sequential liquid crystal display apparatus capable of suppressing an occurrence of the color shift.

Solution to Problem

In a first aspect, the present invention provides a color-field sequential liquid crystal display apparatus that divides one frame period into a plurality of fields and displays different colors in different fields to perform color display. The color-field sequential liquid crystal display apparatus includes a liquid crystal panel on which an image is displayed; a backlight that irradiates the liquid crystal panel with light; an input image data separation unit that separates input image data into input gradation data for every field; a data compensation unit that determines applied gradation data, which corresponds to voltage to be applied to the liquid crystal panel, by compensating the input image data while acquiring liquid crystal state data, which corresponds to expected attained gradation at the end of each field; a liquid crystal panel driving unit that drives the liquid crystal panel on the basis of the applied gradation data; and a backlight driving unit that drives the backlight so that the liquid crystal panel is irradiated with light of different colors in different fields. The data compensation unit includes a liquid-crystal state data acquirer that acquires the liquid crystal state data about a current field on the basis of the input gradation data about the current field and the liquid crystal state data about a first previous field of the current field and that is provided for each field composing one frame period; and an applied gradation data determiner that determines the applied gradation data about the current field by compensating the input gradation data about the current field on the basis of the liquid crystal state data about the first previous field of the current field and that is provided for each field composing one frame period. The applied gradation data determiner determines the applied gradation data so that a display luminance in each field is a display luminance corresponding to the input gradation data resulting from the separation by the input image data separation unit. The provision of the liquid-crystal state data acquirer and the applied gradation data determiner for every field composing one frame period allows the applied gradation data about an arbitrary displayed field to be determined by acquiring the liquid crystal state data about a first previous field of the displayed field on the basis of the input gradation data about the first previous field of the displayed field and the liquid crystal state data about a second previous field of the displayed field and compensating the input gradation data about the displayed field on the basis of the acquired liquid crystal state data.

In a second aspect of the present invention, in the first aspect, the data compensation unit includes a field memory that is capable of holding data corresponding to one field; one frame period is divided into P-number fields, in which P is an integer larger than or equal to three; the liquid crystal state data about a P-th field is held in the field memory; the liquid-crystal state data acquirer for a first field acquires the liquid crystal state data about the first field of a current frame on the basis of the input gradation data about the first field of the current frame and the liquid crystal state data about the P-th field of a previous frame, which is held in the field memory; the applied gradation data determiner for the first field determines the applied gradation data about the first field of the current frame by compensating the input gradation data about the first field of the current frame on the basis of the liquid crystal state data about the P-th field of the previous frame, which is held in the field memory; the liquid-crystal state data acquirer for a Q-th field, in which Q is an integer larger than or equal to two and smaller than or equal to P, acquires the liquid crystal state data about the Q-th field of the current frame on the basis of the input gradation data about the Q-th field of the current frame and the liquid crystal state data about a (Q−1)-th field of the current frame; and the applied gradation data determiner for the Q-th field determines the applied gradation data about the Q-th field of the current frame by compensating the input gradation data about the Q-th field of the current frame on the basis of the liquid crystal state data about the (Q−1)-th field of the current frame.

In a third aspect of the present invention, in the first aspect, the color-field sequential liquid crystal display apparatus further includes a data conversion unit that divides the area of the liquid crystal panel into a plurality of subareas to determine a light emitting luminance of the backlight corresponding to each subarea on the basis of the input gradation data about each pixel included in each subarea and that converts the input gradation data resulting from the separation by the input image data separation unit on the basis of the light emitting luminance. Converted input gradation data converted by the data conversion unit is supplied to the data compensation unit as the input gradation data. The backlight driving unit drives the backlight so that the backlight corresponding to each subarea emits light on the basis of the light emitting luminance determined by the data compensation unit.

In a fourth aspect of the present invention, in the first aspect, the liquid-crystal state data acquirer includes a liquid-crystal state data acquisition lookup table in which values associated with the input gradation data about the current field, values associated with the liquid crystal state data about the first previous field of the current field, and values corresponding to combinations of the values associated with the input gradation data about the current field and the values associated with the liquid crystal state data about the first previous field of the current field are stored; the liquid crystal state data about the current field is acquired on the basis of the liquid-crystal state data acquisition lookup table; the applied gradation data determiner includes an applied gradation data determination lookup table in which values associated with the input gradation data about the current field, values associated with the liquid crystal state data about the first previous field of the current field, and values corresponding to combinations of the values associated with the input gradation data about the current field and the values associated with the liquid crystal state data about the first previous field of the current field are stored; and the applied gradation data about the current field is acquired on the basis of the applied gradation data determination lookup table.

In a fifth aspect of the present invention, in the first aspect, one frame period is divided into three fields including a red field in which a red screen is displayed, a green field in which a green screen is displayed, and a blue field in which a blue screen is displayed.

In a sixth aspect of the present invention, in the first aspect, one frame period is divided into four fields including a white field in which a white screen is displayed, a red field in which a red screen is displayed, a green field in which a green screen is displayed, and a blue field in which a blue screen is displayed.

In a seventh aspect of the present invention, in the first aspect, one frame period is divided into at least three fields each capable of display of a mixed color screen, and screens of different colors are displayed in the at least three fields.

In an eighth aspect of the present invention, in the first aspect, the liquid crystal panel includes a pixel electrode arranged in a matrix pattern; a common electrode arranged so as to be opposed to the pixel electrode; a liquid crystal sandwiched between the pixel electrode and the common electrode; a scanning signal line; a video signal line to which a video signal corresponding to the applied gradation data is applied; and a thin film transistor a control terminal of which is connected to the scanning signal line, a first conductive terminal of which is connected to the video signal line, a second conductive terminal of which is connected to the pixel electrode, and a channel layer of which is formed of oxide semiconductor.

In a ninth aspect of the present invention, in the eighth aspect, the oxide semiconductor contains indium (In), gallium (Ga), zinc (Zn), and oxygen (O) as major components.

In a tenth aspect, the present invention provides a method of driving a color-field sequential liquid crystal display apparatus that includes a liquid crystal panel on which an image is displayed and a backlight that irradiates the liquid crystal panel with light and that divides one frame period into a plurality of fields and displays different colors in different fields to perform color display. The method includes an input image data separating step of separating input image data into input gradation data for every field; a data compensating step of determining applied gradation data, which corresponds to voltage to be applied to the liquid crystal panel, by compensating the input image data while acquiring liquid crystal state data, which corresponds to expected attained gradation at the end of each field; a liquid crystal panel driving step of driving the liquid crystal panel on the basis of the applied gradation data; and a backlight driving step of driving the backlight so that the liquid crystal panel is irradiated with light of different colors in different fields. The data compensating step includes a liquid-crystal state data acquiring step of acquiring the liquid crystal state data about a current field on the basis of the input gradation data about the current field and the liquid crystal state data about a first previous field of the current field; and an applied gradation data determining step of determining the applied gradation data about the current field by compensating the input gradation data about the current field on the basis of the liquid crystal state data about the first previous field of the current field. The applied gradation data determining step determines the applied gradation data so that a display luminance in each field is a display luminance corresponding to the input gradation data acquired in the input image data separating step. The applied gradation data about an arbitrary displayed field is determined by acquiring the liquid crystal state data about a first previous field of the displayed field on the basis of the input gradation data about the first previous field of the displayed field and the liquid crystal state data about a second previous field of the displayed field and compensating the input gradation data about the displayed field on the basis of the acquired liquid crystal state data.

Advantageous Effects of Invention

According to the first aspect of the present invention, the color-field sequential liquid crystal display apparatus includes the liquid-crystal state data acquirer, which acquires the liquid-crystal state data about the current field on the basis of the input gradation data about the current field and the liquid-crystal state data (data corresponding to expected attained gradation at the end of the previous field) about the previous field (the first previous field of the current field), and the applied gradation data determiner, which determines the applied gradation data about the current field by compensating the input gradation data about the current field on the basis of the liquid-crystal state data about the previous field. Accordingly, it is possible to perform the compensation to enhance the temporal change of the values of data for the input image data so that the integral value of the luminance values during the turning on of the backlight reaches a target display luminance in consideration of the change in the liquid crystal state in all the previous fields. Consequently, even when the liquid crystal state is varied during the turning on of the backlight, a desired display luminance is achieved in each field. As described above, the color-field sequential liquid crystal display apparatus is realized, which is capable of suppressing an occurrence of the color shift.

According to the second aspect of the present invention, advantages similar to those in the first aspect of the present invention are reliably achieved.

According to the third aspect of the present invention, the liquid crystal display apparatus includes the data conversion unit that performs the so-called local dimming. Accordingly, the color-field sequential liquid crystal display apparatus is realized, which is capable of reducing the power consumption of the backlight while suppressing an occurrence of the color shift.

According to the fourth aspect of the present invention, even when many kinds of the liquid crystal panels exist, it is sufficient to change the values in the lookup tables (the liquid-crystal state data acquisition lookup table and the applied gradation data determination lookup table) depending on response characteristics of each liquid crystal panel.

According to the fifth aspect of the present invention, advantages similar to those in the first aspect of the present invention are achieved in the color-field sequential liquid crystal display apparatus adopting the common configuration of one frame period.

According to the sixth aspect of the present invention, one frame period is composed of the white field, the red field, the green field, and the blue field. In other words, one frame period includes a field for display of a color mixture component of at least two colors of the three primary colors, in addition to the three fields. In each of the three fields, the single color display of each color in the three primary colors is performed. Accordingly, an occurrence of the color breakup is suppressed. As described above, the color-field sequential liquid crystal display apparatus is realized, which is capable of suppressing an occurrence of the color breakup and suppressing an occurrence of the color shift.

According to the seventh aspect of the present invention, one frame period is composed of at least three fields each capable of display of a mixed color screen. Accordingly, as in the sixth aspect of the present invention, the color-field sequential liquid crystal display apparatus is realized, which is capable of suppressing an occurrence of the color breakup and suppressing an occurrence of the color shift.

According to the eighth aspect of the present invention, in the color-field sequential liquid crystal display apparatus, the thin film transistor the channel layer of which is formed of oxide semiconductor is used as the thin film transistor provided in the liquid crystal panel. Accordingly, the writing speed is increased, compared with that in the related art, in addition to achievement of the advantages of increase in fineness and reduction in power consumption. As a result, an occurrence of the color shift is more effectively suppressed.

According to the ninth aspect of the present invention, use of indium gallium zinc oxide as the oxide semiconductor forming the channel layer reliably achieves advantages similar to those achieved in the eighth aspect of the present invention.

According to the tenth aspect of the present invention, advantages similar to those in the first aspect of the present invention are achieved in the method of driving the color-field sequential liquid crystal display apparatus.

BRIEF DESCRIPTION OF DRAWINGS

FIG. 13 is an exemplary gradation luminance table of green.

FIG. 14 is an exemplary gradation luminance table of blue.

FIG. 18 includes diagrams for describing how to acquire the liquid-crystal state value.

FIG. 20 illustrates an exemplary liquid-crystal state value acquisition lookup table.

DESCRIPTION OF EMBODIMENTS

0. Introduction

The outline of the present invention will now be described with reference to FIG. 2 to FIG. 20 before embodiments are described. Liquid crystal display apparatuses capable of 256-gradation display are exemplified in the description here and the description of the embodiments.

<0.1 Concept of the Present Invention>

Figure 2:
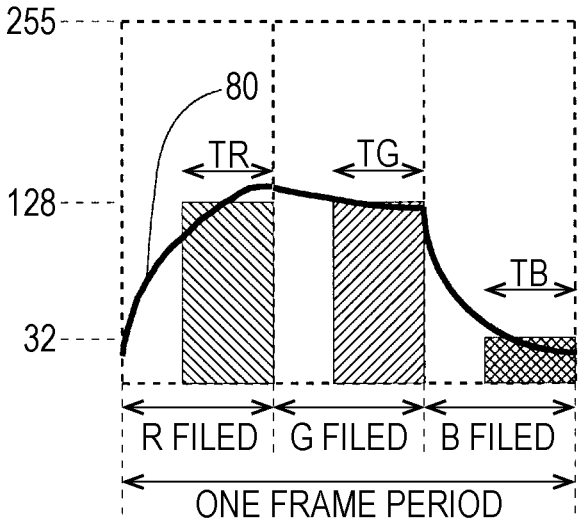
FIG. 2 is a waveform diagram for describing a method of acquiring a desired display luminance in a color-field sequential liquid crystal display apparatus.

As described above, in a typical color-field sequential liquid crystal display apparatus, the liquid crystal state is varied also during the turning on of the backlight even if the transmittance reaches a target value in each field through the overdrive driving, thereby causing the color shift. Accordingly, as a method of achieving a desired display luminance in the color-field sequential liquid crystal display apparatus, control of an applied gradation value (a gradation value associated with the value of voltage to be actually applied to the liquid crystal) in each field so that the liquid crystal state is varied in a manner illustrated in a bold line 80 in FIG. 2 is proposed. Specifically, further enhancement of the temporal change of the values of data, compared with the overdrive driving, is proposed so that the integral value of the luminance values during the turning on of the backlight reaches a target display luminance. In the example illustrated in FIG. 2, the RGB combination of an input gradation value (a target display gradation value) is "R=128, G=128, and B=32", the RGB combination of a target attained gradation value is "R=183, G=105, and B=2", and the RGB combination of the applied gradation value is "R=238, G=89, and B=0."

Figure 3:
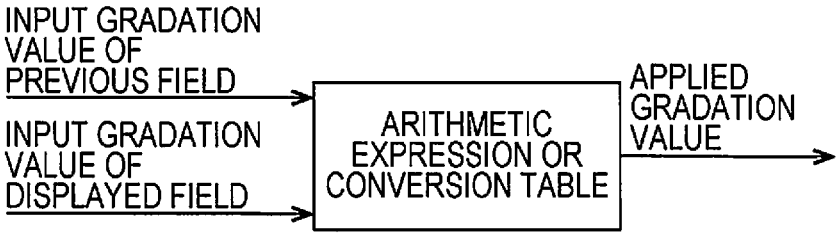
FIG. 3 Related Art
FIG. 3 is a diagram for describing overdrive driving in the related art.

In the overdrive driving in the related art, the applied gradation value of the displayed field is acquired on the basis of the input gradation value of the previous field (the first previous field of the displayed field) and the input gradation value of the displayed field. Specifically, as illustrated in FIG. 3, the applied gradation value of the displayed field is acquired on the basis of the input gradation value of the previous field and the input gradation value of the displayed field using an arithmetic expression or a conversion table. In other words, the input gradation value of the displayed field is converted into the applied gradation value of the displayed field on the basis of the input gradation value of the previous field.

Here, for example, a first case and a second case will now be considered. In the first case, a color of an RGB combination of "R=128, G=128, and B=32" is to be displayed. In the second case, a color of an RGB combination of "R=128, G=128, and B=94" is to be displayed.

Figure 4:
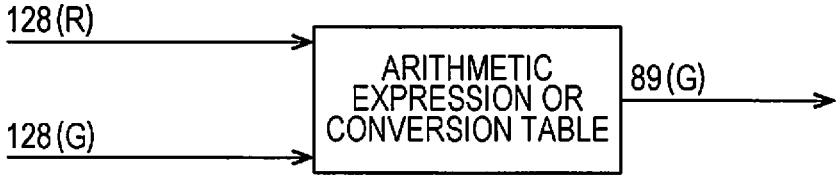
FIG. 4 Related Art
FIG. 4 is a diagram for describing the overdrive driving in the related art.

In the first case, the RGB combination of the target attained gradation value is "R=183, G=105, and B=2." The RGB combination of the applied gradation value for realizing the target attained gradation value using the overdrive driving is "R=238, G=89, and B=0." Accordingly, for example, in the case of the applied gradation value of the green field, as illustrated in FIG. 4, the value "89" should be acquired on the basis of the input gradation value "128" of the red field and the input gradation value "128" of the green field using an arithmetic expression or a conversion table.

Figure 5:
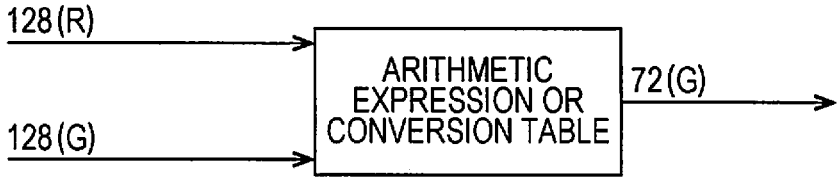
FIG. 5 Related Art
FIG. 5 is a diagram for describing the overdrive driving in the related art.

In the second case, the RGB combination of the target attained gradation value is "R=148, G=120, and B=84." The RGB combination of the applied gradation value for realizing the RGB combination of the target attained gradation value using the overdrive driving is "R=168, G=112, and B=72." Accordingly, in the case of the applied gradation value of the green field, as illustrated in FIG. 5, the value "72" should be acquired on the basis of the input gradation value "128" of the red field and the input gradation value "128" of the green field using an arithmetic expression or a conversion table.

In the above examples, the values of the two pieces of data input into the arithmetic expression or the conversion table in the first case are equal to the values of the two pieces of data input into the arithmetic expression or the conversion table in the second case. However, the values of the pieces of data to be acquired in the first case are different from the values of the pieces of data to be acquired in the second case. This means that, "when only the arithmetic expression or the conversion table is used in the same manner as in the related art, it is not possible to acquire the applied gradation value at which the integral value of the luminance values during the turning on of the backlight reaches the target display luminance."

Accordingly, in the present invention, the applied gradation value of each field is acquired through a data conversion process described below, which is different from that in the related art, so that the integral value of the luminance values during the turning on of the backlight reaches the target display luminance. The gradation value corresponding to the liquid crystal state (the state of orientation of liquid crystal molecules) at each time is hereinafter referred to as "a liquid-crystal state value."

Figure 6:
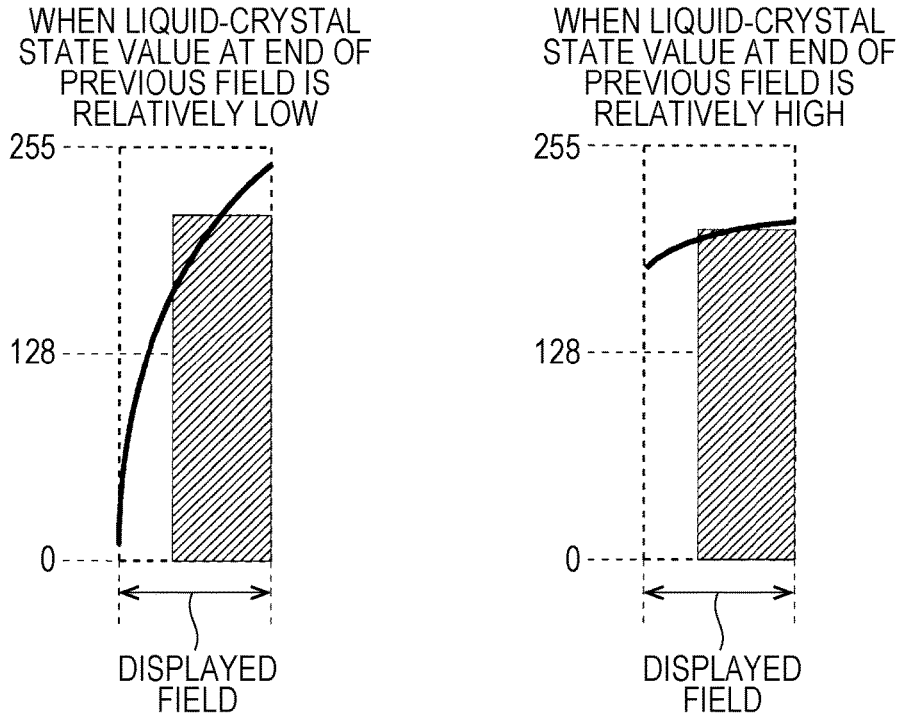
FIG. 6 includes waveform diagrams for describing data necessary to acquire an applied gradation value of a displayed field.

In acquisition of one target display luminance (the luminance corresponding to the input gradation value) in the displayed field (the current field), the target attained gradation value is varied depending on the liquid-crystal state value at the end of the previous field (the first previous field of the displayed field), as illustrated in FIG. 6. In the example illustrated in FIG. 6, the target attained gradation value of the displayed field when the liquid-crystal state value at the end of the previous field is relatively low is higher than that when the liquid-crystal state value at the end of the previous field is relatively high. The applied gradation value of the displayed field when the liquid-crystal state value at the end of the previous field is relatively low is also higher than that when the liquid-crystal state value at the end of the previous field is relatively high. Accordingly, the applied gradation value of the displayed field should be acquired on the basis of the input gradation value of the displayed field and the liquid-crystal state value at the end of the previous field. In other words, it is necessary to use the liquid-crystal state value at the end of the previous field, in addition to the input gradation value of the displayed field, as the data for determining the applied gradation value of the displayed field.

Figure 7:
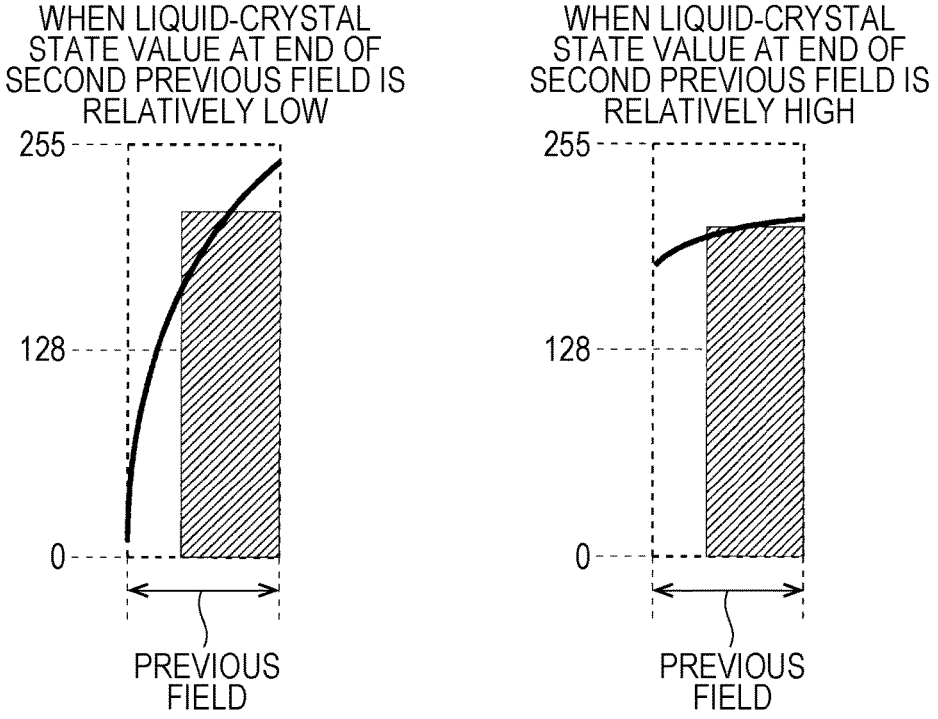
FIG. 7 includes waveform diagrams for describing data necessary to acquire a liquid-crystal state value at the end of a previous field.

In terms of one target display luminance of the previous field, the liquid-crystal state value at the end of the previous field is varied depending on the liquid-crystal state value at the end of the second previous field of the displayed field, as illustrated in FIG. 7. In the example illustrated in FIG. 7, the liquid-crystal state value at the end of the previous field when the liquid-crystal state value at the end of the second previous field of the displayed field is relatively low is higher than that when the liquid-crystal state value at the end of the second previous field of the displayed field is relatively high. Accordingly, the liquid-crystal state value at the end of the previous field should be acquired on the basis of the input gradation value of the previous field and the liquid-crystal state value at the end of the second previous field of the displayed field. In other words, it is necessary to use the liquid-crystal state value at the end of the second previous field of the previous field, in addition to the input gradation value of the previous field, as the data for acquiring the liquid-crystal state value at the end of the previous field.

Figure 8:
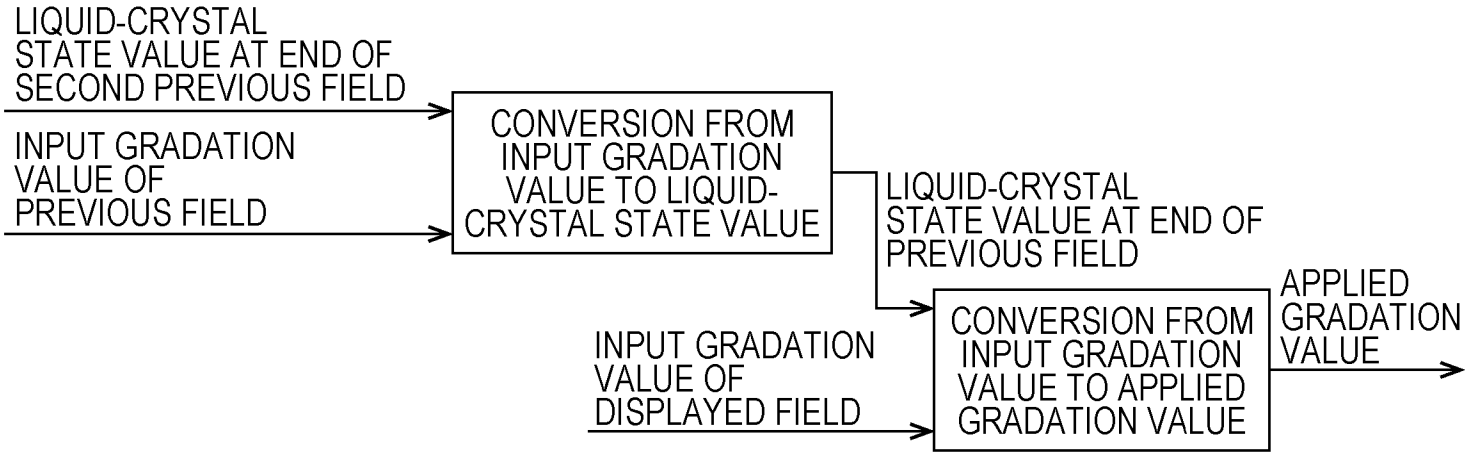
FIG. 8 is a diagram for describing a data conversion process for determining the applied gradation value of the displayed field.

In consideration of the above facts, in the present invention, "a process of converting the input gradation value of the previous field into the liquid-crystal state value at the end of the previous field on the basis of the liquid-crystal state value at the end of the second previous field" and "a process of converting the input gradation value of the displayed field into the applied gradation value of the displayed field on the basis of the liquid-crystal state value at the end of the previous field" are performed as the data conversion process for determining the applied gradation value of the displayed field, as illustrated in FIG. 8.

Figure 9:
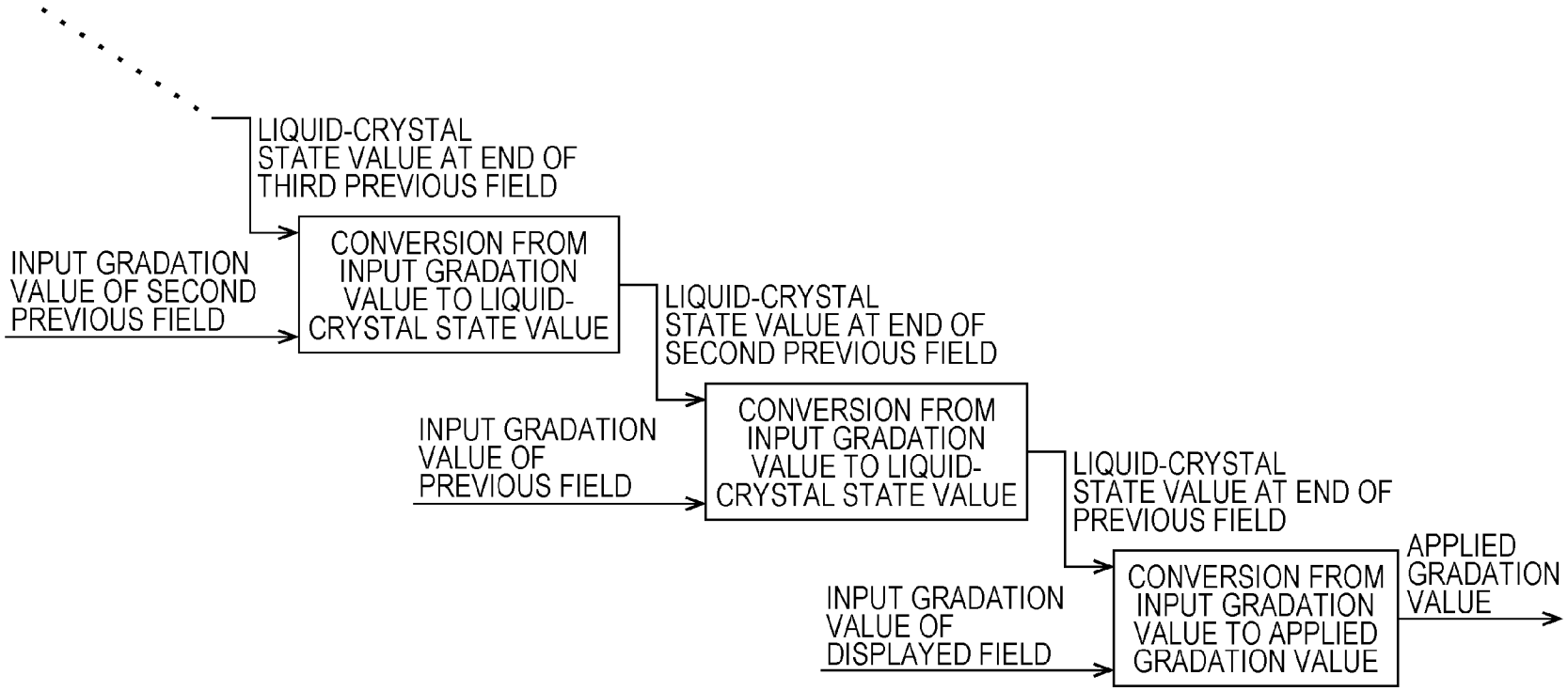
FIG. 9 is a diagram for describing a data conversion process for determining the applied gradation value of the displayed field.

"The liquid-crystal state value at the end of the second previous field" in FIG. 8 is acquired by converting "the input gradation value of the second previous field" on the basis of "the liquid-crystal state value at the end of the third previous field." As described above, the liquid-crystal state value at the end of each field is acquired in consideration of the liquid-crystal state values at the end of all the previous fields, as illustrated in FIG. 9.

Figure 10:
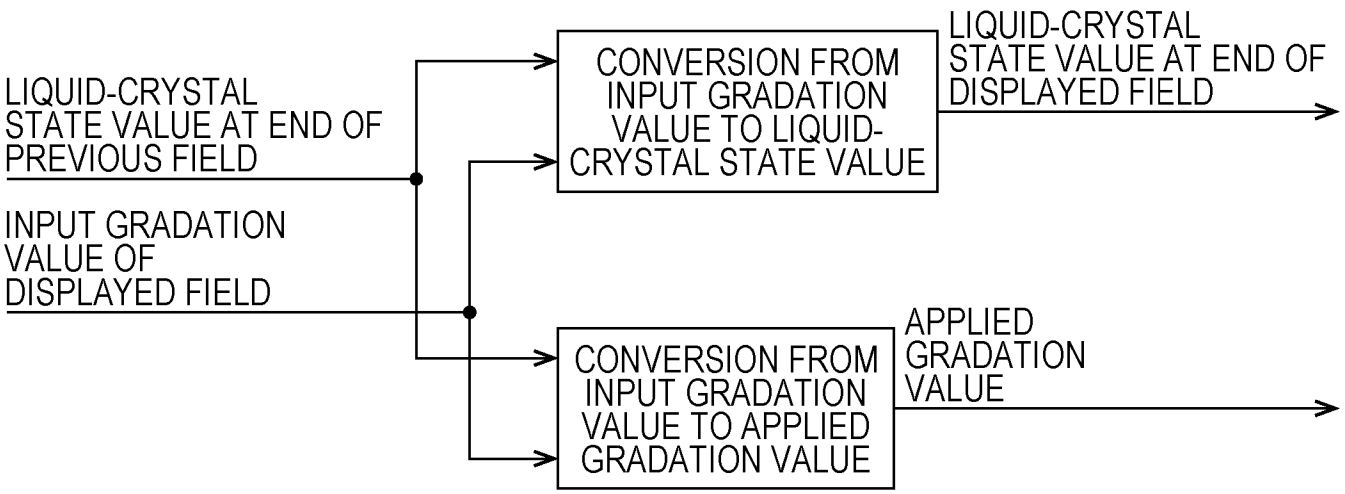
FIG. 10 is a diagram for describing a data conversion process performed when data about an arbitrary displayed field is input.

The liquid-crystal state value at the end of the displayed field is used for determining the applied gradation value of a field next to the displayed field. Accordingly, when data about an arbitrary displayed field is input, as illustrated in FIG. 10, "a process of converting the input gradation value of the displayed field into the liquid-crystal state value at the end of the displayed field on the basis of the liquid-crystal state value at the end of the previous field" and "a process of converting the input gradation value of the displayed field into the applied gradation value of the displayed field on the basis of the liquid-crystal state value at the end of the previous field" are performed.

Accordingly, the liquid crystal display apparatus according to the present invention includes a data conversion unit of acquiring the liquid-crystal state value at the end of the displayed field on the basis of the input gradation value of the displayed field (the current field) and the liquid-crystal state value at the end of the first previous field of the displayed field (hereinafter referred to as "a liquid-crystal state value acquirer") and a data conversion unit of determining the applied gradation value of the displayed field by compensating the input gradation value of the displayed field on the basis of the liquid-crystal state value at the end of the first previous field of the displayed field (hereinafter referred to as "an applied gradation value determiner"). Since the correspondence between the gradation value and the luminance value is varied for every field, the liquid-crystal state value acquirer and the applied gradation value determiner are provided for each field composing one frame period. For example, when one frame period is composed of three fields, three liquid-crystal state value acquirers and three applied gradation value determiners are provided in the liquid crystal display apparatus.

<0.2 How to Acquire Applied Gradation Value>

As described above, in the present invention, the applied gradation value of the displayed field is acquired on the basis of the input gradation value of the displayed field and the liquid-crystal state value at the end of the previous field. In order to realize this, the liquid crystal display apparatus according to the present invention includes a conversion table in which "values associated with the input gradation value of the displayed field", "values associated with the liquid-crystal state value at the end of the previous field, and "applied gradation values corresponding to the combinations of the values" are stored. Here, "the value associated with the input gradation value of the displayed field" is the input gradation value applicable to the liquid crystal display apparatus and "the value associated with the liquid-crystal state value at the end of the previous field" is the liquid-crystal state value applicable to the liquid crystal display apparatus. Instead of the conversion table, a process using an arithmetic expression that performs the same conversion may be performed. How to acquire the applied gradation value to be stored in the conversion table will now be described. It is assumed here that one frame period is composed of the three fields: the red field, the green field, and the blue field.

Figures 11, 12:
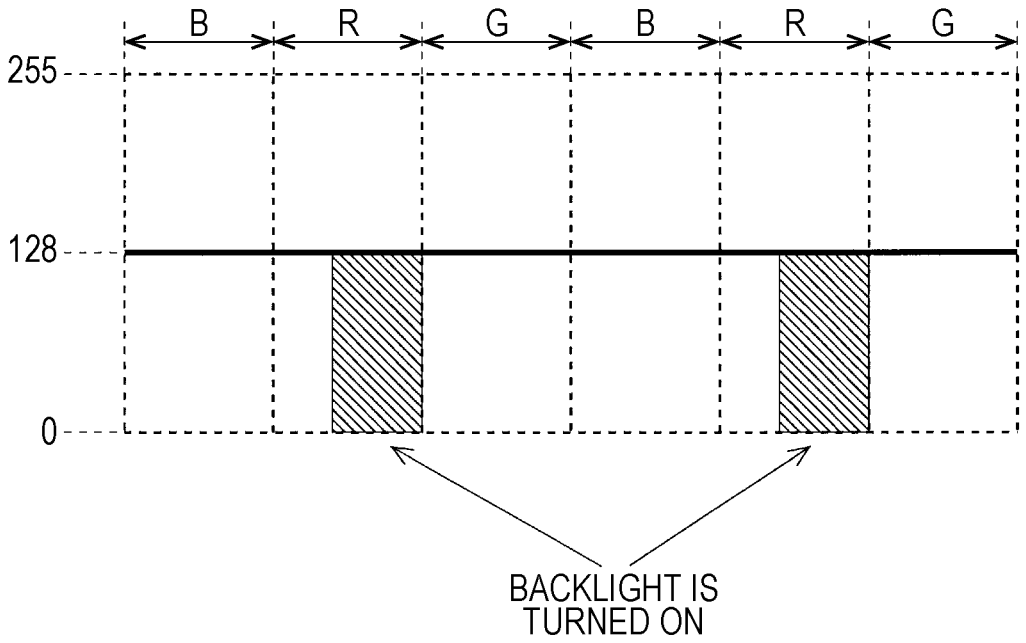
FIG. 11 is a diagram for describing how to acquire the applied gradation value.
FIG. 12 is an exemplary gradation luminance table of red.

First, the luminance value corresponding to each gradation value (input gradation value) is measured for each color. For example, in the measurement of the luminance value corresponding to the red gradation value "128", the applied gradation values in all the fields are set to "128" and the backlight is turned on only in each red field, as illustrated in FIG. 11. The luminance value at this time is measured by, for example, a luminance meter. Setting the applied gradation values in all the fields to the same value allows the luminance value corresponding to each gradation value of each color when the liquid crystal state is not varied to be acquired. As a result, "a gradation luminance table", which is a table in which the gradation values are associated with the luminance values, is created for each color. FIG. 12 is an example of the gradation luminance table of red. FIG. 13 is an example of the gradation luminance table of green. FIG. 14 is an example of the gradation luminance table of blue. For example, FIG. 12 illustrates that "the luminance value corresponding to the red gradation value "253" is "73.133"

(candela per square meter)." The unit of the luminance value is omitted in the following description.

Figure 15:
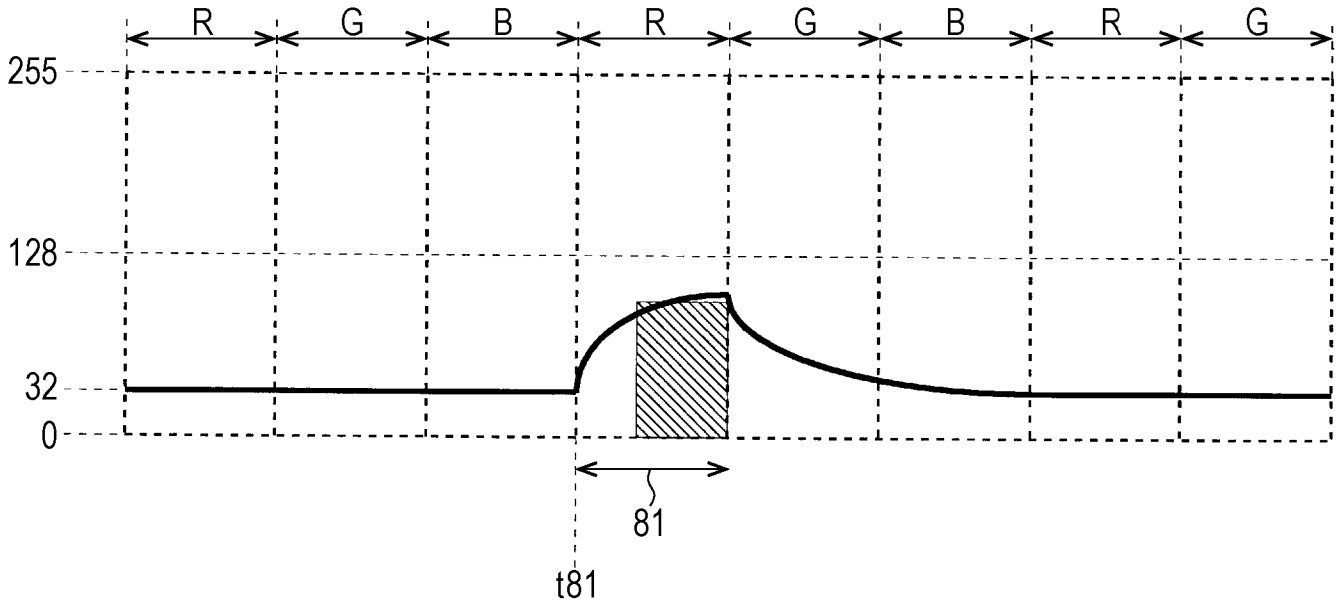
FIG. 15 is a diagram for describing how to acquire the applied gradation value.
Figure 16:
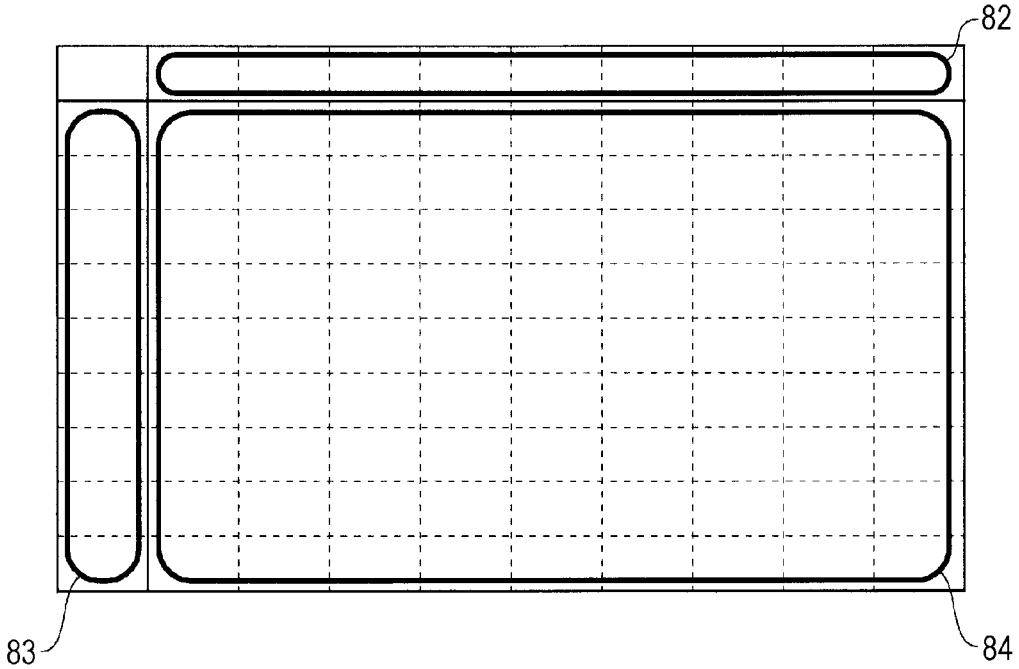
FIG. 16 is a diagram for describing an applied gradation value determination lookup table.

Next, the luminance value is measured when the applied gradation value of a certain field is varied and the backlight is turned on only in the certain field. For example, as illustrated in FIG. 15, the applied gradation value is changed to "128" in a field (red field) denoted by reference numeral 81 from a state in which the liquid-crystal state value is kept at "32" and the backlight is turned on only in this field. At this time, when the field denoted by reference numeral 81 is assumed to be the displayed field, "the liquid-crystal state value at a time t81" corresponds to "the liquid-crystal state value at the end of the previous field." In the example illustrated in FIG. 15, "the input gradation value of the displayed field" the applied gradation value of which is to be set to "128" when the liquid-crystal state value at the end of the previous field is "32" is acquired on the basis of the result of the measurement performed in the above manner and the gradation luminance table described above. For example, when the luminance vale of the field denoted by reference numeral 81 in FIG. 15 is "30.0" and the luminance value corresponding to the gradation value "100" in the gradation luminance table of red is "30.0", the applied gradation value when "the liquid-crystal state value at the end of the previous field is "32" and the input gradation value of the displayed field is "100"" is set to "128."

Figure 17:
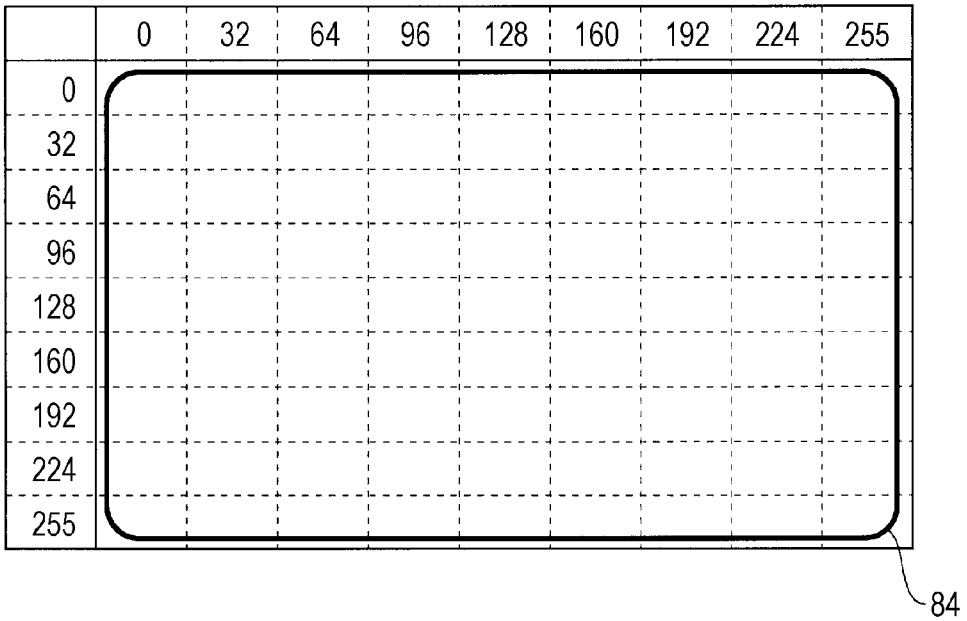
FIG. 17 is a diagram for describing the applied gradation value determination lookup table.

The applied gradation value corresponding to the combination of each input gradation value of the displayed field and each liquid-crystal state value at the end of the previous field is acquired for each color in the above manner. This creates a conversion table illustrated in FIG. 16 (hereinafter referred to as "an applied gradation value determination lookup table"). The applied gradation value determination lookup table illustrated in FIG. 16 includes an area 82 in which values associated with the input gradation value of the displayed field are stored, an area 83 in which values associated with the liquid-crystal state value at the end of the previous field are stored, and an area 84 in which the applied gradation values corresponding to the combinations of the input gradation value of the displayed field and the liquid-crystal state value at the end of the previous field are stored. Values incremented by "32" from zero are stored in the area 82 and the area 83, for example, as illustrated in FIG. 17. The applied gradation values acquired in the above manner are stored in the area 84.

As described above, in the example illustrated in FIG. 17, the values incremented by "32" from zero are stored in the applied gradation value determination lookup table as the values associated with the input gradation value of the displayed field and the values associated with the liquid-crystal state value at the end of the previous field. However, if an increase in capacity of the memory is permitted, values incremented by "1" from zero may be stored in the area 82 in FIG. 16 and the area 83 in FIG. 16. The same applies to a liquid-crystal state value acquisition lookup table described below. When values incremented by a plural number are stored as the values associated with the input gradation value of the displayed field and the values associated with the liquid-crystal state value at the end of the previous field, as in the example illustrated in FIG. 17, "the applied gradation values of the displayed field" corresponding to values that are not stored in the area 82 and values that are not stored in the area 83 may be acquired through, for example, a linear interpolation process. This applies to the liquid-crystal state value acquisition lookup table described below.

<0.3 How to Acquire Liquid-Crystal State Value>

The liquid-crystal state value is used to acquire the applied gradation value in the present invention. The liquid-crystal state value at the end of the displayed field is acquired on the basis of the input gradation value of the displayed field and the liquid-crystal state value at the end of the previous field, as described above. In order to realize this, the liquid crystal display apparatus according to the present invention includes a conversion table in which "values associated with the input gradation value of the displayed field", "values associated with the liquid-crystal state value at the end of the previous field", and "the liquid-crystal state values corresponding to the combinations of the values" are stored. Instead of the conversion table, a process using an arithmetic expression that performs the same conversion may be performed. How to acquire the liquid-crystal state value to be stored in the conversion table will now be described. It is difficult to directly acquire the liquid-crystal state value at the end of each field. Accordingly, the liquid-crystal state value at the end of each field is indirectly estimated, as described below. How to acquire the liquid-crystal state value at the end of the red field is exemplified here. The liquid-crystal state values at the end of the green field and the blue field are acquired in the same manner as in the red field.

Figure 19:
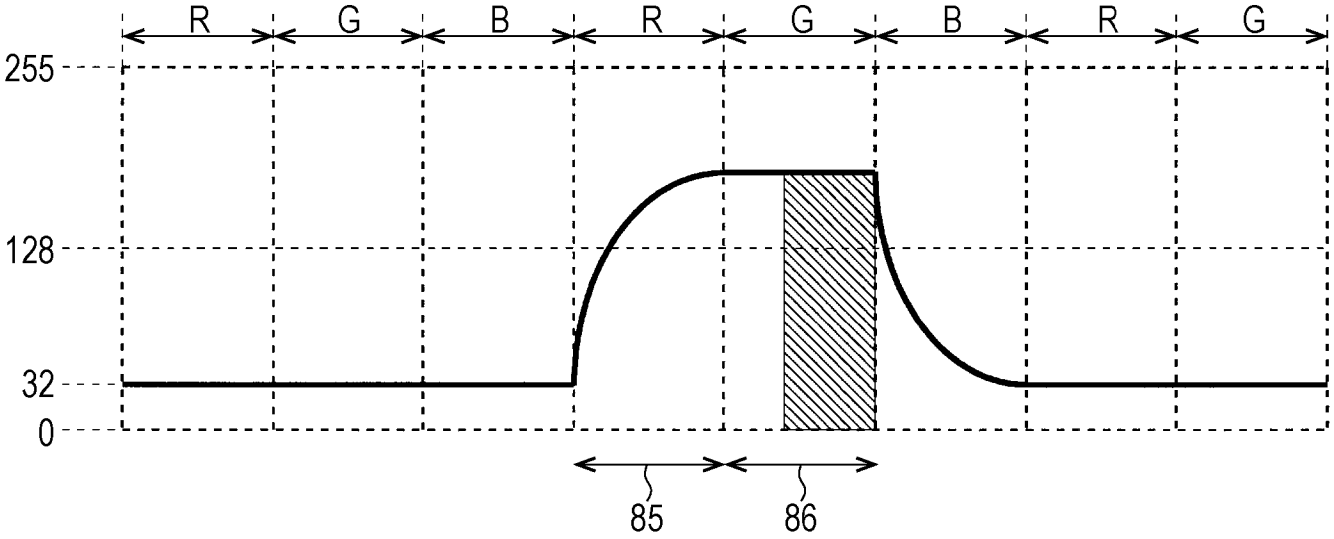
FIG. 19 is a diagram for describing how to acquire the liquid-crystal state value.

First, the backlight is turned on only in the green field in a state in which the same (constant) input gradation value is applied to the liquid crystal panel in all the fields and the luminance value at this time is measured. This measurement is performed for the input gradation values from "0" to "255." This measurement (referred to as "first measurement" for convenience here) provides the luminance values corresponding to the input gradation values from "0" to "255", as in a table denoted by reference letter and numeral R1 in FIG. 18 (also refer to FIG. 13). At this time, "the input gradation value=the applied gradation value." Next, for example, as illustrated in FIG. 19, the applied gradation value "238" at which the display gradation value of the red field (a field denoted by reference numeral 85) is "128" is applied to the liquid crystal panel in a state in which the liquid-crystal state value is kept at "32" (that is, a state in which the applied gradation value is kept at "32"). Then, the backlight is turned on in the green field (for example, a field denoted by reference numeral 86), which is the next field, and the luminance value at this time is measured. This measurement is performed with the input gradation value of the green field being varied from "0" to "255." This measurement (referred to as "second measurement" for convenience here) provides the luminance values corresponding to the input gradation values from "0" to "255", as in a table denoted by reference letter and numeral R2 in FIG. 18. The input gradation value at which the luminance value as the result R2 of the second measurement is equal to the luminance value as the result R1 of the first measurement is estimated as "the liquid-crystal state value at the end of the previous field (the red field)" when "the liquid-crystal state value at the end of the second previous field (the blue field) is "32" and the input gradation value of the previous field (the red field) is "128"." For example, if a value denoted by reference letter and numeral K1 in FIG. 18 is equal to a value denoted by reference letter and numeral K2 in FIG. 18, the input gradation value "183" is estimated as the liquid-crystal state value at the end of the red field.

The liquid-crystal state values corresponding to the combinations of the respective input gradation values of the displayed field and the respective liquid-crystal state values at the end of the previous field are estimated in the above manner. This creates a conversion table illustrated in FIG. 20 (hereinafter referred to as "the liquid-crystal state value acquisition lookup table"). Numerical values in the liquid-crystal state value acquisition lookup table illustrated in FIG. 20 are only examples. The format of the liquid-crystal state value acquisition lookup table is the same as that of the applied gradation value determination lookup table described above (refer to FIG. 16). Specifically, the liquid-crystal state value acquisition lookup table includes an area in which values associated with the input gradation value of the displayed field are stored, an area in which values associated with the liquid-crystal state value at the end of the previous field are stored, and an area in which the liquid-crystal state values corresponding to the combinations of the input gradation values of the displayed field and the liquid-crystal state values at the end of the previous field are stored.

Embodiments of the present invention will herein be described with reference to the attached drawings in consideration of the above content.

1. First Embodiment

<1.1 Entire Configuration and Outline of Operation>

Figure 21:
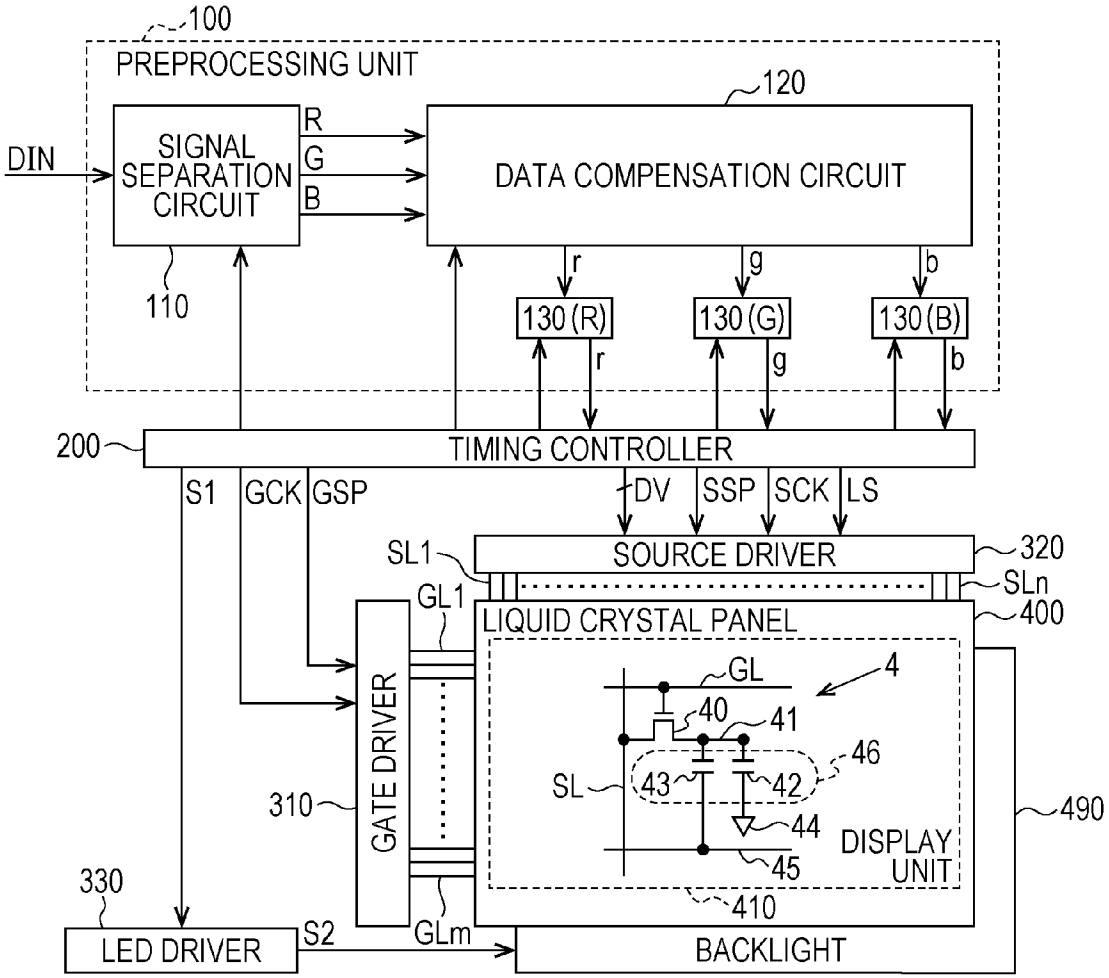
FIG. 21 is a block diagram illustrating the entire configuration of the liquid crystal display apparatus according to the first embodiment.

FIG. 21 is a block diagram illustrating the entire configuration of a liquid crystal display apparatus according to a first embodiment of the present invention. This liquid crystal display apparatus is composed of a preprocessing unit 100, a timing controller 200, a gate driver 310, a source driver 320, a LED driver 330, a liquid crystal panel 400, and a backlight 490. The gate driver 310 or the source driver 320, or both the gate driver 310 and the source driver 320 may be provided in the liquid crystal panel 400. The liquid crystal panel 400 includes a display unit 410 in which an image is displayed. The preprocessing unit 100 includes a signal separation circuit 110, a data compensation circuit 120, a red field memory 130(R), a green field memory 130(G), and a blue field memory 130(B). In the present embodiment, a light emitting diode (LED) is adopted as a light source of the backlight 490. Specifically, a red LED, a green LED, and a blue LED compose the backlight 490. In the present embodiment, the timing controller 200, the gate driver 310, and the source driver 320 compose a liquid crystal panel driving unit, and the LED driver 330 composes a backlight driving unit. The signal separation circuit 110 composes an input image data separation unit.

Figure 22:
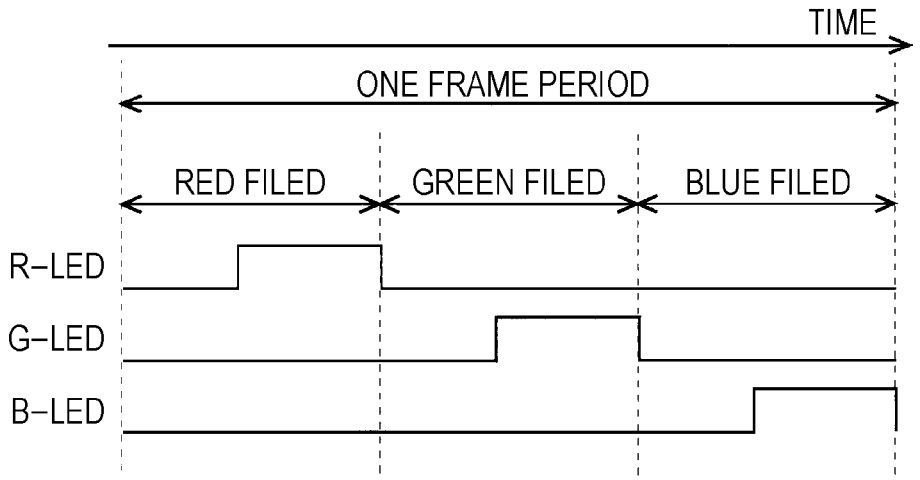
FIG. 22 illustrates the structure of one frame period in the first embodiment.

The liquid crystal display apparatus according to the present embodiment adopts the field sequential method. FIG. 22 illustrates the structure of one frame period in the present embodiment. One frame period is divided into a red field in which a red screen is displayed on the basis of red components of an input image signal DIN, a green field in which a green screen is displayed on the basis of green components of the input image signal DIN, and a blue field in which a blue screen is displayed on the basis of blue components of the input image signal DIN. In the red field, the red LED is turned on after a predetermined time period from a time when the field is started. In the green field, the green LED is turned on after the predetermined time period from a time when the field is started. In the blue field, the blue LED is turned on after the predetermined time period from a time when the field is started. While the liquid crystal display apparatus is operating, the red field, the green field, and the blue field are repeated. This causes the red screen, the green screen, and the blue screen to be repeatedly displayed to display a desired color image in the display unit 410. The order of the fields is not especially limited. The fields may be repeated in an order of "the blue field, the green field, and the red field." The length of the time period during which the LED is turned on in each field is preferably determined in consideration of response characteristics of the liquid crystal.

Referring to FIG. 21, multiple (n-number) source bus lines (video signal lines) SL1 to SLn and multiple (m-number) gate bus lines (scanning signal lines) GL1 to GLm are provided in the display unit 410. A pixel former 4 that forms a pixel is provided at each intersection of the source bus lines SL1 to SLn and the gate bus lines GL1 to GLm. In other words, the display unit 410 includes multiple (n×m-number) pixel formers 4. The multiple pixel formers 4 are arranged in a matrix pattern to compose an m-row×n-column pixel matrix. Each pixel former 4 includes a thin film transistor (TFT) 40, which is a switching element a gate terminal of which is connected to the gate bus line GL passing through the corresponding intersection and a source terminal of which is connected to the source bus line SL passing through the corresponding intersection; a pixel electrode 41 connected to a drain terminal of the TFT 40; a common electrode 44 and an auxiliary capacitance electrode 45 commonly provided for the multiple pixel formers 4; a liquid crystal capacitance 42 formed of the pixel electrode 41 and the common electrode 44; and an auxiliary capacitance 43 formed of the pixel electrode 41 and the auxiliary capacitance electrode 45. The liquid crystal capacitance 42 and the auxiliary capacitance 43 compose a pixel capacitance 46. Only components corresponding to one pixel former 4 are illustrated in the display unit 410 in FIG. 21.

For example, an oxide TFT (a thin film transistor using oxide semiconductor in a channel layer) may be adopted as the TFT 40 in the display unit 410. More specifically, a TFT the channel layer of which is formed of In—Ga—Zn—O (indium gallium zinc oxide), which is oxide semiconductor containing indium (In), gallium (Ga), zinc (Zn), and oxygen (O) as major components (such a TFT is hereinafter referred to as "In—Ga—Zn—O-TFT") may be adopted as the TFT 40. The adoption of such In—Ga—Zn—O-TFT not only achieves the advantages of increase in fineness and reduction in power consumption but also increases the writing speed, compared with that in the related art. Alternatively, a transistor using oxide semiconductor other than In—Ga—Zn—O (indium gallium zinc oxide) in the channel layer may be adopted. For example, the same advantages are achieved also when a transistor using oxide semiconductor containing at least one of indium, gallium, zinc, copper (Cu), silicon (Si), tin (Sn), aluminum (Al), calcium (Ca), germanium (Ge), and lead (Pb) in the channel layer is adopted. Use of a TFT other than the oxide TFT is not eliminated in the present invention.

An operation of the components illustrated in FIG. 21 will now be described. The signal separation circuit 110 in the preprocessing unit 100 separates the input image signal DIN supplied from the outside into red input gradation data R, green input gradation data G, and blue input gradation data B.

The data compensation circuit 120 in the preprocessing unit 100 compensates the pieces of input gradation data (the red input gradation data R, the green input gradation data G, and the blue input gradation data B) supplied from the signal separation circuit 110 to data associated with voltage to be applied to the liquid crystal panel 400 and outputs compensated data as pieces of applied gradation data (red-field applied gradation data r, green-field applied gradation data g, and blue-field applied gradation data b). The data compensation circuit 120 will be described in detail below.

The red-field applied gradation data r, the green-field applied gradation data g, and the blue-field applied gradation data b, which are supplied from the data compensation circuit 120, are stored in the red field memory 130(R), the green field memory 130(G), and the blue-field memory 130(B), respectively.

The timing controller 200 reads out the red-field applied gradation data r, the green-field applied gradation data g, and the blue-field applied gradation data b from the red field memory 130(R), the green field memory 130(G), and the blue-field memory 130(B), respectively, and outputs a digital video signal DV; a gate start pulse signal GSP and a gate clock signal GCK for controlling the operation of the gate driver 310; a source start pulse signal SSP, a source clock signal SCK, and a latch strobe signal LS for controlling the operation of the source driver 320; and an LED driver control signal S1 for controlling the operation of the LED driver 330.

The gate driver 310 repeats application of an active scanning signal to each gate bus line GL on a cycle of one vertical scanning period on the basis of the gate start pulse signal GSP and the gate clock signal GCK supplied from the timing controller 200.

The source driver 320 receives the digital video signal DV, the source start pulse signal SSP, the source clock signal SCK, and the latch strobe signal LS, which are supplied from the timing controller 200, and applies a driving video signal to each source bus line SL. At this time, the digital video signal DV, which indicates the voltage to be applied to each source bus line SL, is sequentially held in the source driver 320 at a timing of generation of the pulse of the source clock signal SCK. The digital video signal DV that is held is converted into analog voltage at a timing of generation of the pulse of the latch strobe signal LS. The analog voltage resulting from the conversion is simultaneously applied to all the source bus lines SL1 to SLn as the driving video signal.

The LED driver 330 outputs a light source control signal S2 for controlling the state of each LED composing the backlight 490 on the basis of the LED driver control signal S1 supplied from the timing controller 200. In the backlight 490, switching of the state of each LED (switching between the turned-on state and the turned-off state) is appropriately performed on the basis of the light source control signal S2. In the present embodiment, the state of each LED is switched in a manner illustrated in FIG. 22.

The application of the scanning signal to the gate bus lines GL1 to GLm, the application of the driving video signal to the source bus lines SL1 to SLn, and the appropriate switching of the state of each LED in the above manner causes an image corresponding to the input image signal DIN to be displayed in the display unit 410 in the liquid crystal panel 400.

<1.2 Data Compensation Circuit>

Figure 1:
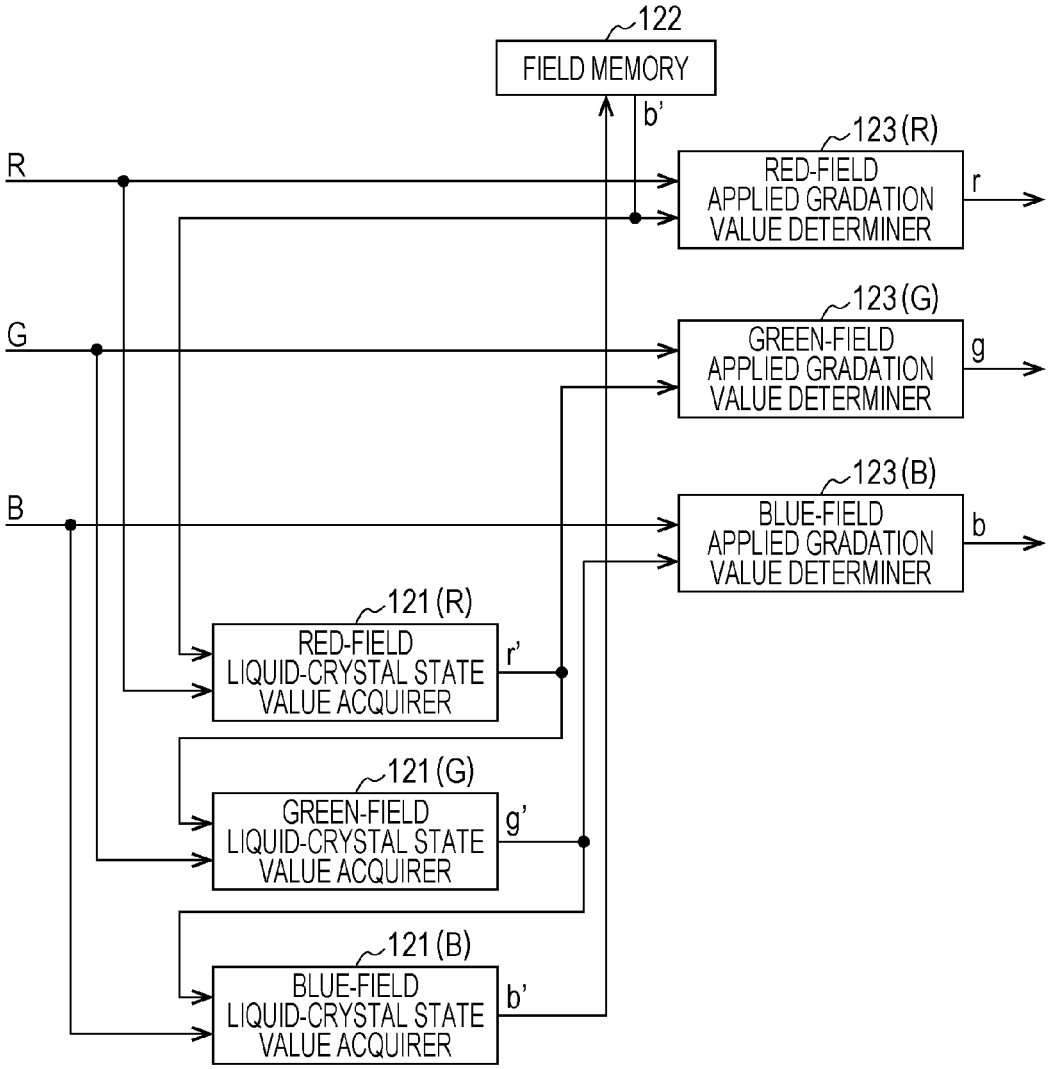
FIG. 1 is a block diagram illustrating the configuration of a data compensation circuit in a liquid crystal display apparatus according to a first embodiment of the present embodiment.

A configuration and an operation of the data compensation circuit 120 will now be described in detail. FIG. 1 is a block diagram illustrating the configuration of the data compensation circuit 120 in the present embodiment. The data compensation circuit 120 is composed of a red-field liquid-crystal state value acquirer 121(R), a green-field liquid-crystal state value acquirer 121(G), a blue-field liquid-crystal state value acquirer 121(B), a field memory 122, a red-field applied gradation value determiner 123(R), a green-field applied gradation value determiner 123(G), and a blue-field applied gradation value determiner 123(B). The red-field liquid-crystal state value acquirer 121(R), the green-field liquid-crystal state value acquirer 121(G), and the blue-field liquid-crystal state value acquirer 121(B) are collectively simply referred to as "a liquid-crystal state value acquirer." The liquid-crystal state value acquirer is denoted by reference numeral 121. The red-field applied gradation value determiner 123(R), the green-field applied gradation value determiner 123(G), and the blue-field applied gradation value determiner 123(B) are collectively simply referred to as "an applied gradation value determiner." The applied gradation value determiner is denoted by reference numeral 123.

The liquid-crystal state value acquirer 121 includes the liquid-crystal state value acquisition lookup table described above and acquires the liquid-crystal state value at the end of the displayed field on the basis of the input gradation value (the value of the input gradation data) of the displayed field and the liquid-crystal state value at the end of the previous field (the first previous field of the displayed field). The data indicating the liquid-crystal state value acquired by the liquid-crystal state value acquirer 121 is output from the liquid-crystal state value acquirer 121 as liquid-crystal state data. The field memory 122 holds liquid-crystal state data b' output from the blue-field liquid-crystal state value acquirer 121(B) corresponding to the blue field, which is the last field of one frame period, during one frame period. The liquid-crystal state data b' of each frame, which is stored in the field memory 122, is used by the red-field liquid-crystal state value acquirer 121(R) in the next frame. The applied gradation value determiner 123 includes the applied gradation value determination lookup table described above and acquires the applied gradation value of the displayed field on the basis of the input gradation value of the displayed field and the liquid-crystal state value at the end of the previous field. The liquid-crystal state value acquirer 121 and the applied gradation value determiner will be described in detail below.

<1.2.1 Liquid-Crystal State Value Acquirer>

The red-field liquid-crystal state value acquirer 121(R) outputs liquid-crystal state data r' indicating the liquid-crystal state value at the end of the red field in each frame on the basis of the red input gradation data R and the liquid-crystal state data (the data indicating the liquid-crystal state value at the end of the blue field in the first previous frame) b', which is stored in the field memory 122. The green-field liquid-crystal state value acquirer 121(G) outputs liquid-crystal state data g' indicating the liquid-crystal state value at the end of the green field in each frame on the basis of the green input gradation data G and the liquid-crystal state data (the data indicating the liquid-crystal state value at the end of the red field) r', which is supplied from the red-field liquid-crystal state value acquirer 121(R). The blue-field liquid-crystal state value acquirer 121(B) outputs the liquid-crystal state data b' indicating the liquid-crystal state value at the end of the blue field in each frame on the basis of the blue input gradation data B and the liquid-crystal state data (the data indicating the liquid-crystal state value at the end of the green field) g', which is supplied from the green-field liquid-crystal state value acquirer 121(G).

Figure 23:
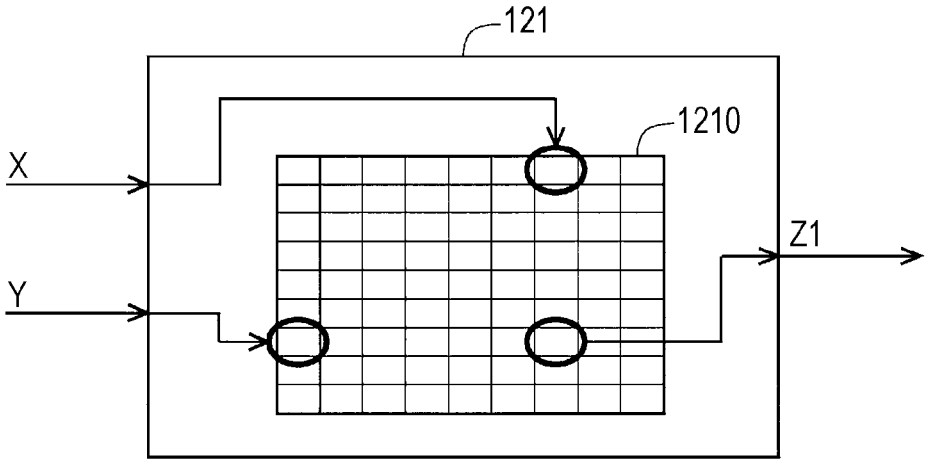
FIG. 23 is a diagram for describing the liquid-crystal state value acquisition lookup table in the first embodiment.

In the present embodiment, a liquid-crystal state value acquisition lookup table 1210 is provided in each liquid-crystal state value acquirer 121. "The value associated with the input gradation value of the displayed field", "the value associated with the liquid-crystal state value at the end of the previous field", and "the liquid-crystal state value corresponding to the combination of the values" are stored in the liquid-crystal state value acquisition lookup table 1210. As illustrated in FIG. 23, in the liquid-crystal state value acquisition lookup table 1210, the value corresponding to the combination of an input gradation value X of the displayed field and a liquid-crystal state value Y at the end of the previous field is used as a liquid-crystal state value Z1 at the end of the displayed field.

Since the liquid-crystal state value acquirer 121 having the above configuration is provided, the liquid-crystal state values at the end of the red field, the green field, and the blue field are acquired in consideration of the change in the liquid crystal state in all the previous fields in the present embodiment.

<1.2.2 Applied Gradation Value Determiner>

The red-field applied gradation value determiner 123(R) outputs the red-field applied gradation data r in each frame on the basis of the red input gradation data R and the liquid-crystal state data (the data indicating the liquid-crystal state value at the end of the blue field in the first previous frame) b', which is stored in the field memory 122. The green-field applied gradation value determiner 123(G) outputs the green-field applied gradation data g in each frame on the basis of the green input gradation data G and the liquid-crystal state data (the data indicating the liquid-crystal state value at the end of the red field) r', which is supplied from the red-field liquid-crystal state value acquirer 121(R). The blue-field applied gradation value determiner 123(B) outputs the blue-field applied gradation data b on the basis of the blue input gradation data B and the liquid-crystal state data (the data indicating the liquid-crystal state value at the end of the green field) g', which is supplied from the green-field liquid-crystal state value acquirer 121(G).

Figure 24:
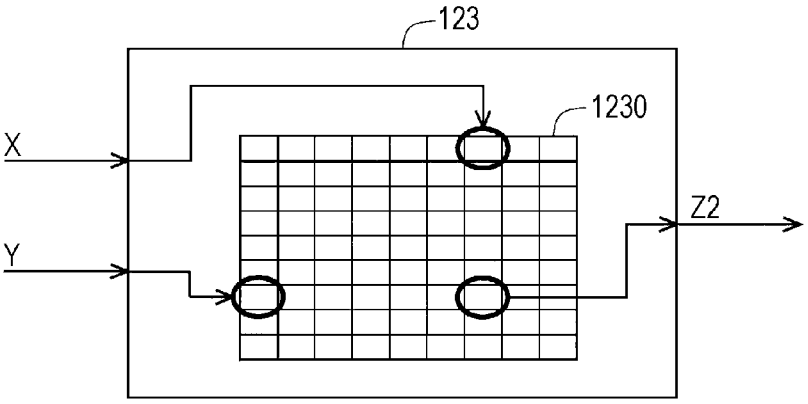
FIG. 24 is a diagram for describing the applied gradation value determination lookup table in the first embodiment.

In the present embodiment, an applied gradation value determination lookup table 1230 is provided in each applied gradation value determiner 123. "The value associated with the input gradation value of the displayed field", "the value associated with the liquid-crystal state value at the end of the previous field", and "the applied gradation value corresponding to the combination of the values" are stored in the applied gradation value determination lookup table 1230. As illustrated in FIG. 24, in the applied gradation value determination lookup table 1230, the value corresponding to the combination of the input gradation value X of the displayed field and the liquid-crystal state value Y at the end of the previous field is used as an applied gradation value Z2 of the displayed field.

Since the applied gradation value determiner 123 having the above configuration is provided, the applied gradation values of the red field, the green field, and the blue field are acquired in consideration of the liquid crystal state at the end of the first previous field in the present embodiment.

<1.3 Advantages>

The color-field sequential liquid crystal display apparatus according to the present embodiment includes the liquid-crystal state value acquirer 121, which acquires the liquid-crystal state value at the end of the displayed field on the basis of the input gradation value of the displayed field and the liquid-crystal state value at the end of the previous field (the first previous field of the displayed field), and the applied gradation value determiner 123, which determines the applied gradation value of the displayed field by compensating the input gradation value of the displayed field on the basis of the liquid-crystal state value at the end of the previous field. Accordingly, it is possible to perform the compensation to enhance the temporal change of the values of data for the input image signal so that the integral value of the luminance values during the turning on of the backlight reaches a target display luminance in consideration of the change in the liquid crystal state in all the previous fields. Consequently, even when the liquid crystal state is varied during the turning on of the backlight 490, a desired display luminance is achieved in each field. As described above, according to the present embodiment, the color-field sequential liquid crystal display apparatus is realized, which is capable of suppressing an occurrence of the color shift.

2. Second Embodiment

<2.1 Outline>

Figure 25:
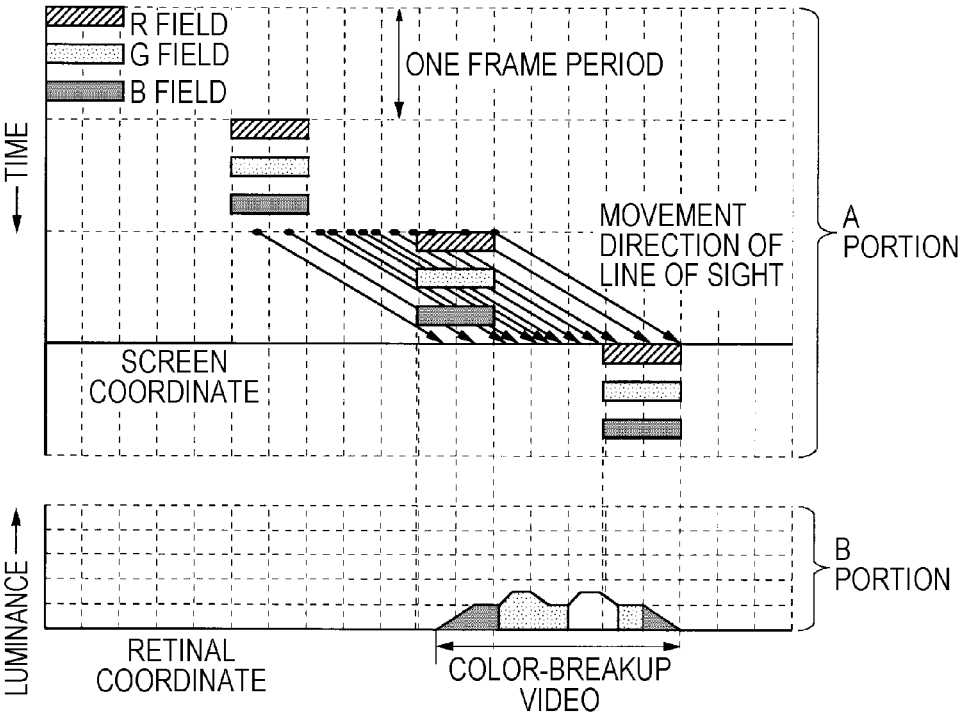
FIG. 25 illustrates a principle of how color breakup occurs.

The color-field sequential liquid crystal display apparatuses have hitherto been known to have a problem in that color breakup occurs. FIG. 25 illustrates a principle of how the color breakup occurs. In an A portion in FIG. 25, the vertical axis represents time and the horizontal axis represents positions on the screen. In general, when an object moves in a displayed screen, the line of sight of an observer follows the object to move in a direction in which the object moves. For example, in the example illustrated in FIG. 25, when a white object moves from left to right in the displayed screen, the line of sight of the observer moves in a direction illustrated by diagonal arrows. When images of the three fields R, G, and B are extracted from a video at the same moment, the position of the object is not varied in the images of the fields. Accordingly, the color breakup occurs in a video caught in the retina of the observer, as illustrated in a B portion in FIG. 25. As a countermeasure against the color breakup, provision in one frame period of a field for display of colors other than the three primary colors, that is, a field for display of at least two colors (mixed color display) is proposed. Specifically, provision of a white field in which a white screen is displayed in one frame period effectively suppresses an occurrence of the color breakup. Accordingly, in the present embodiment, the white field is provided in one frame period.

Figure 26:
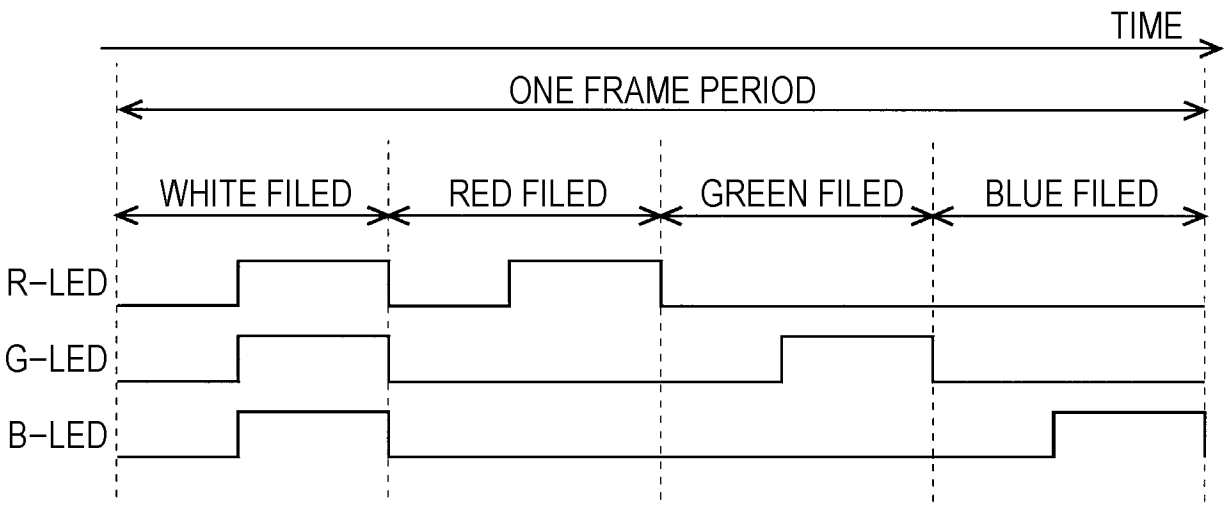
FIG. 26 illustrates the structure of one frame period in a second embodiment of the present invention.

FIG. 26 illustrates the structure of one frame period in the present embodiment. As illustrated in FIG. 26, in the present embodiment, one frame period is divided into the white field, the red field, the green field, and the blue field. In the white field, the red LED, the green LED, and the blue LED are turned on after a predetermined time period from a time when the field is started. In the red field, the red LED is turned on after the predetermined time period from a time when the field is started. In the green field, the green LED is turned on after the predetermined time period from a time when the field is started. In the blue field, the blue LED is turned on after the predetermined time period from a time when the field is started. While the liquid crystal display apparatus is operating, the white field, the red field, the green field, and the blue field are repeated. This causes the white screen, the red screen, the green screen, and the blue screen to be repeatedly displayed to display a desired color image in the display unit 410. The order of the fields is not especially limited. The fields may be repeated in an order of "the white field, the blue field, the green field, and the red field." As described above, each frame includes the white field, in addition to the red field, the green field, and the blue field, in the present embodiment.

<2.2 Configuration>

Figure 27:
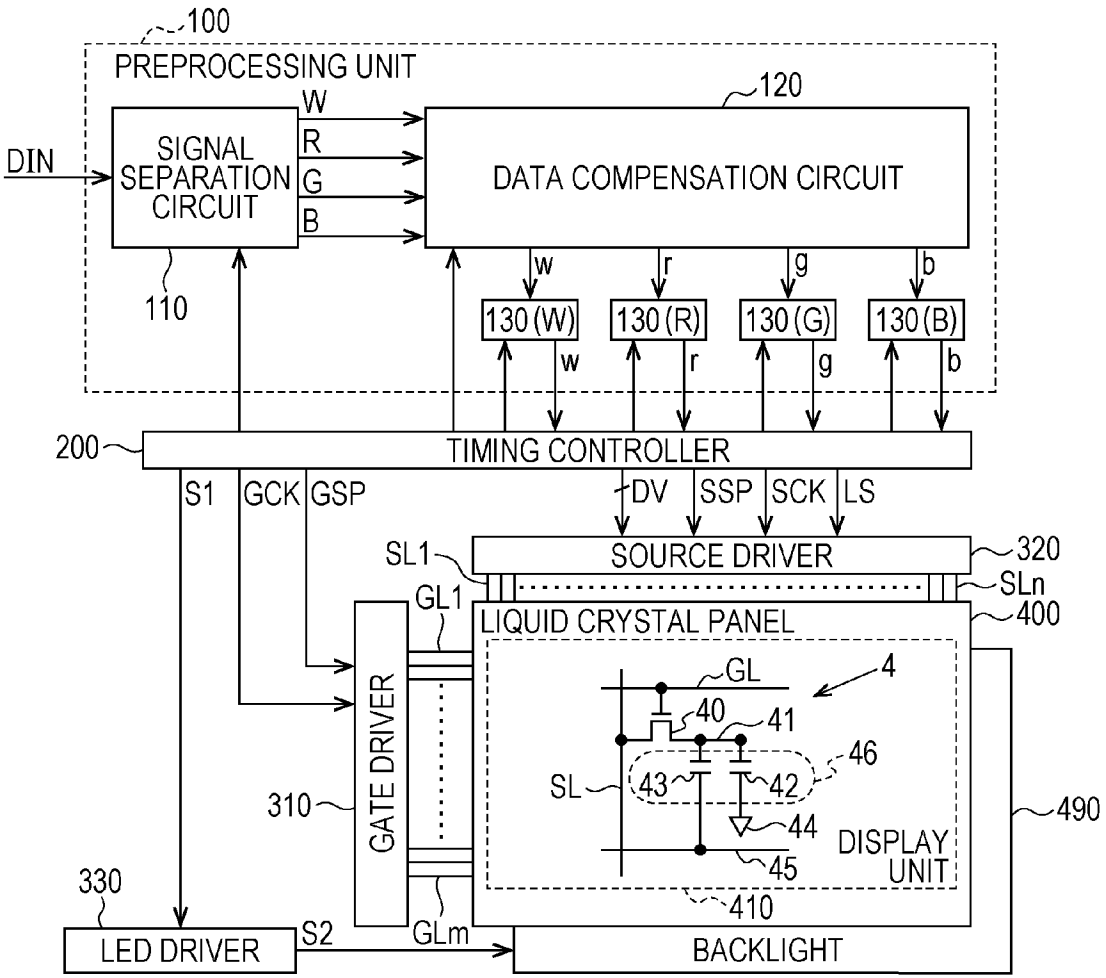
FIG. 27 is a block diagram illustrating the entire configuration of a liquid crystal display apparatus according to the second embodiment.

FIG. 27 is a block diagram illustrating the entire configuration of a liquid crystal display apparatus according to a second embodiment of the present invention. The present embodiment differs from the first embodiment described above in the configuration of the preprocessing unit 100. The preprocessing unit 100 in the present embodiment includes a white field memory 130(W), in addition to the components in the first embodiment. A detailed description of the same points as in the first embodiment is omitted herein.

The signal separation circuit 110 in the preprocessing unit 100 separates the input image signal DIN supplied from the outside into white input gradation data W, the red input gradation data R, the green input gradation data G, and the blue input gradation data B.

The data compensation circuit 120 in the preprocessing unit 100 compensates the pieces of input gradation data (the white input gradation data W, the red input gradation data R, the green input gradation data G, and the blue input gradation data B) supplied from the signal separation circuit 110 to data associated with voltage to be applied to the liquid crystal panel 400 and outputs compensated data as the pieces of applied gradation data (white-field applied gradation data w, the red-field applied gradation data r, the green-field applied gradation data g, and the blue-field applied gradation data b).

The white-field applied gradation data w, the red-field applied gradation data r, the green-field applied gradation data g, and the blue-field applied gradation data b, which are supplied from the data compensation circuit 120, are stored in the white field memory 130(W), the red field memory 130(R), the green field memory 130(G), and the blue-field memory 130(B), respectively.

Figure 28:
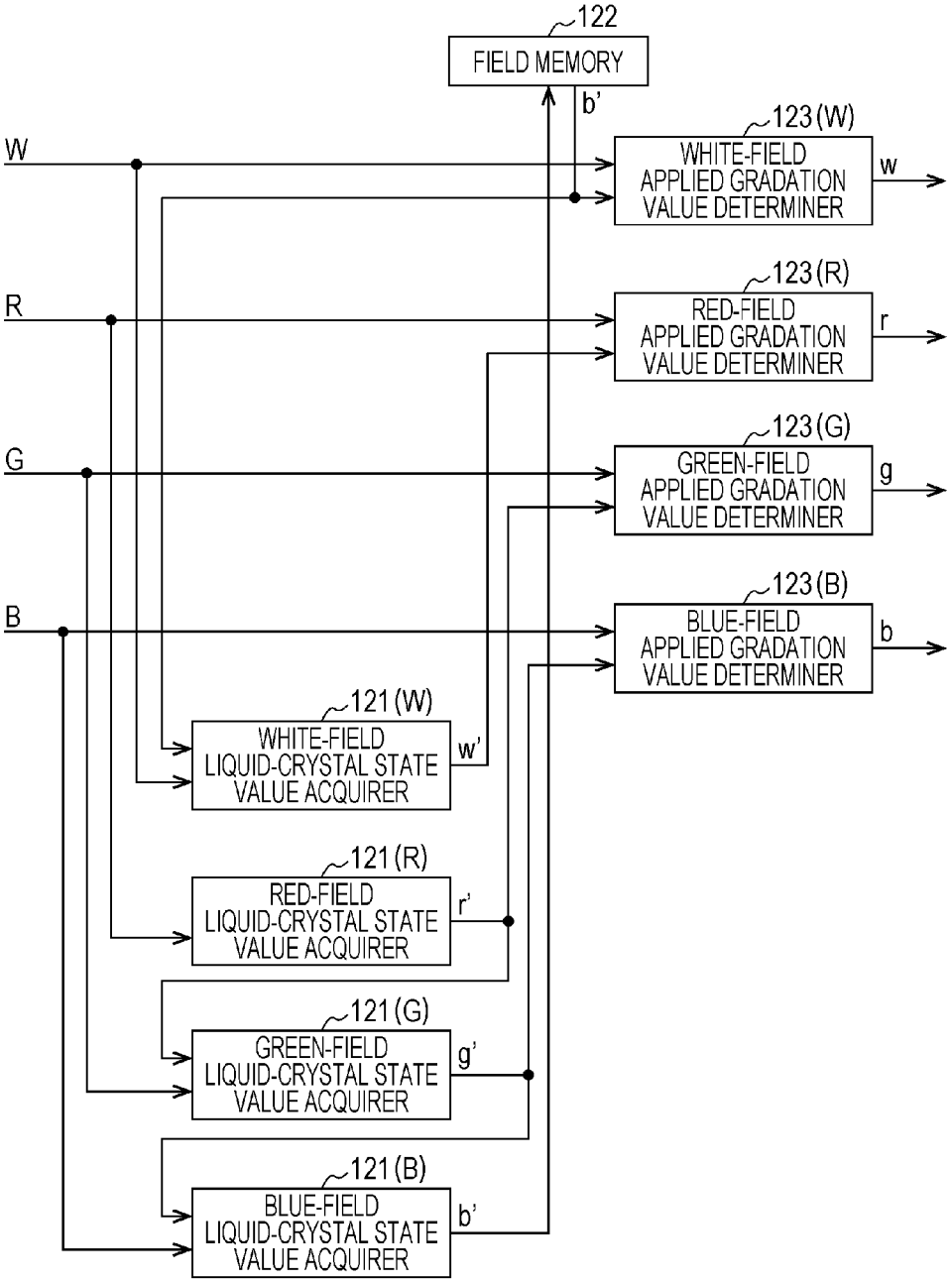
FIG. 28 is a block diagram illustrating the configuration of a data compensation circuit in the second embodiment.

FIG. 28 is a block diagram illustrating the configuration of the data compensation circuit 120 in the present embodiment. As illustrated in FIG. 1 and FIG. 28, in the present embodiment, the data compensation circuit 120 includes a white-field liquid-crystal state value acquirer 121(W) and a white-field applied gradation value determiner 123(W), in addition to the components in the first embodiment. An operation similar to the operation in the first embodiment is performed in the data compensation circuit 120 except that the processing for the red field, the processing for the green field, and the processing for the blue field are sequentially performed after the processing for the white field is performed. Accordingly, a detailed description of the data compensation circuit 120 is omitted herein.

<2.3 Advantages>

According to the present embodiment, as in the first embodiment, in the color-field sequential liquid crystal display apparatus, even when the liquid crystal state is varied during the turning on of the backlight 490, a desired display luminance is achieved in each field. In addition, in the present embodiment, one frame period is composed of the white field, the red field, the green field, and the blue field. In other words, one frame period includes a field for display of a color mixture component of at least two colors of the three primary colors, in addition to the three fields. In each of the three fields, single color display of each color in the three primary colors is performed. Accordingly, an occurrence of the color breakup is suppressed. As described above, the color-field sequential liquid crystal display apparatus is realized, which is capable of suppressing an occurrence of the color breakup and suppressing an occurrence of the color shift.

3. Third Embodiment

<3.1 Outline>

The liquid crystal display apparatuses have hitherto had a challenge to reduction in power consumption. Accordingly, liquid crystal display apparatuses that perform local dimming have been developed in recent years. In the local dimming, a screen is logically divided into multiple areas and the luminance is controlled for every backlight light source (typically, for every LED) corresponding to each area. The luminance of each backlight light source is controlled on the basis of an input image in the corresponding area in the local dimming. Specifically, the luminance of each backlight light source is determined on the basis of, for example, a maximum value or an average value of the target luminance values (the luminance values corresponding to the input gradation values) of the pixels included in the corresponding area. In an area where the luminance of the backlight light source is made smaller than the target luminance, the transmittance of each pixel is increased. This achieves the target display luminance in each pixel.

Figure 29:
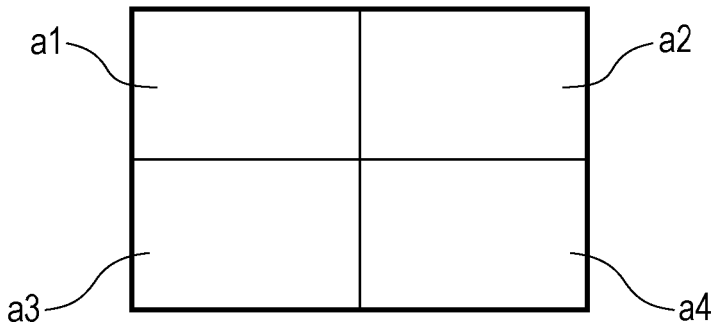
FIG. 29 is a diagram for describing local dimming.

For example, as illustrated in FIG. 29, it is assumed that a screen is logically divided into four areas a1 to a4 (actually divided into areas of a number larger than four). It is also assumed that the luminance of the backlight light source is determined on the basis of the maximum value of the target luminance values of the pixels included in each area. In this case, if the maximum value of the target luminance values of the pixels in the area is "a3>a1>a4>a2", the luminance of the backlight light source is also "a3>a1>a4>a2." Controlling the luminance of the backlight light source in the above manner allows the power consumption of the backlight to be reduced. Accordingly, in the present embodiment, the liquid crystal display apparatus includes a local dimming conversion circuit that performs the local dimming described above.

<3.2 Configuration>

Figure 30:
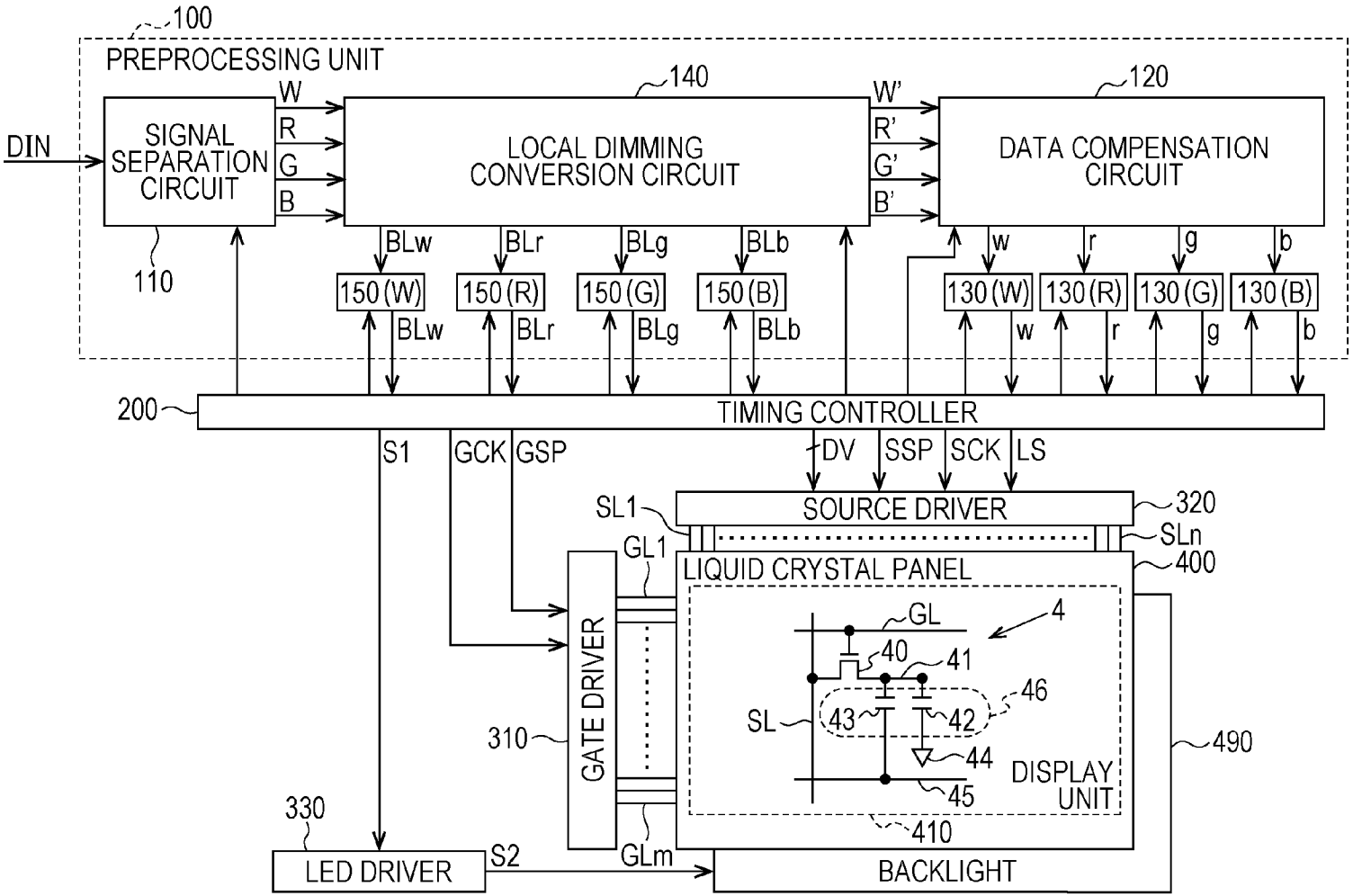
FIG. 30 is a block diagram illustrating the entire configuration of a liquid crystal display apparatus according to a third embodiment of the present invention.

FIG. 30 is a block diagram illustrating the entire configuration of a liquid crystal display apparatus according to a third embodiment of the present invention. The present embodiment differs from the second embodiment described above in the configuration of the preprocessing unit 100. The preprocessing unit 100 in the present embodiment includes a local dimming conversion circuit 140, a backlight control white-field memory 150(W), a backlight control red-field memory 150(R), a backlight control green-field memory 150(G), and a backlight control blue-field memory 150(B), in addition to the components in the second embodiment. In the present embodiment, the local dimming conversion circuit 140 realizes a data conversion unit.

Figure 31:
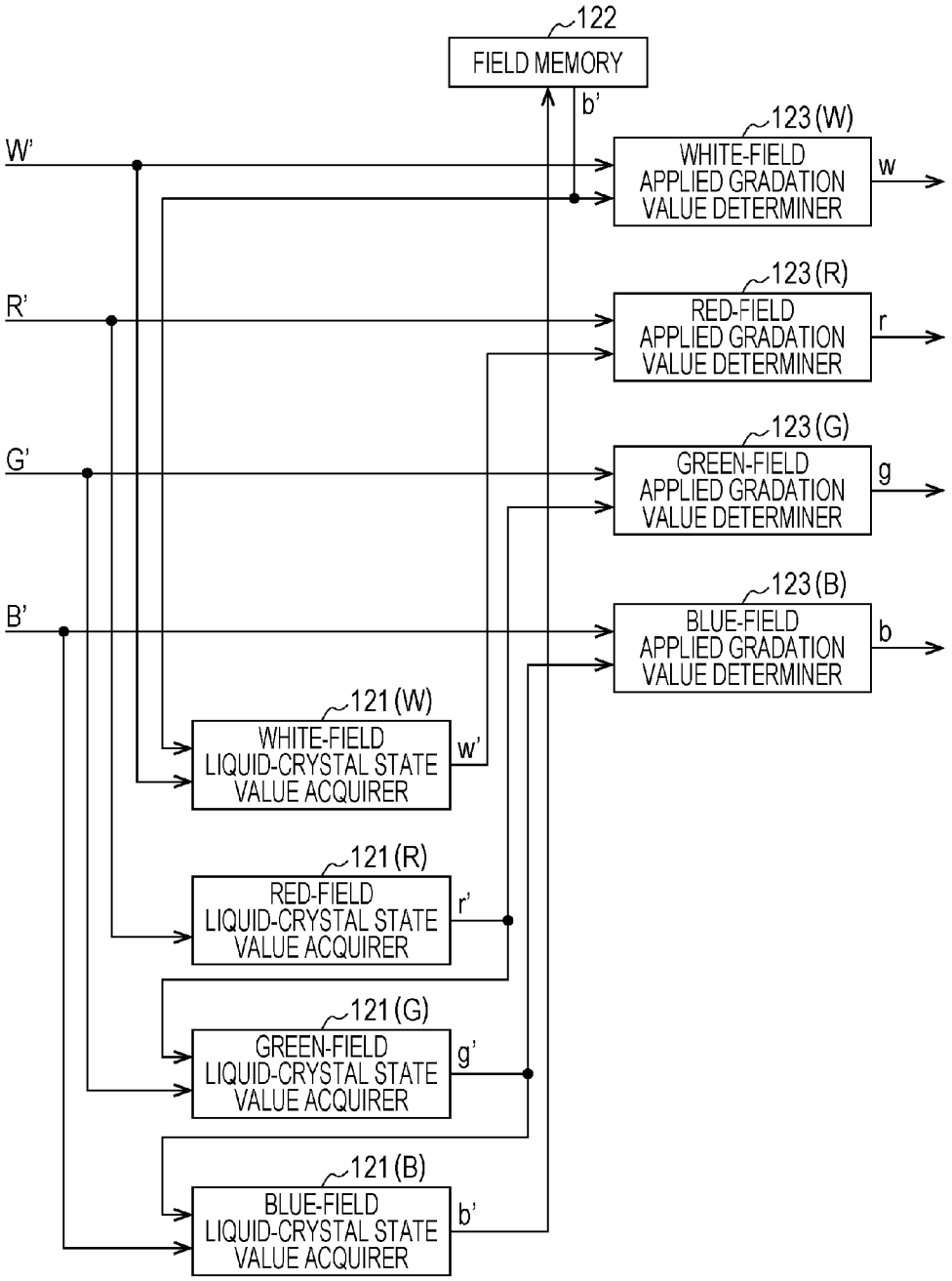
FIG. 31 is a block diagram illustrating the configuration of a data compensation circuit in the third embodiment.

In the signal separation circuit 110 in the preprocessing unit 100, processing similar to that in the second embodiment is performed. In the data compensation circuit 120 in the preprocessing unit 100, processing similar to that in the second embodiment is performed. However, pieces of converted input gradation data described below (white converted input gradation data W', red converted input gradation data R', green converted input gradation data G', and blue converted input gradation data B') are supplied from the local dimming conversion circuit 140 to the data compensation circuit 120 (refer to FIG. 31). The same pieces of data as in the second embodiment (the white-field applied gradation data w, the red-field applied gradation data r, the green-field applied gradation data g, and the blue-field applied gradation data b) are stored in the white field memory 130(W), the red field memory 130(R), the green field memory 130(G), and the blue-field memory 130(B), respectively, in the preprocessing unit 100.

In the local dimming conversion circuit 140 in the preprocessing unit 100, the local dimming described above is performed. In the local dimming conversion circuit 140, first, the luminance of each LED (each backlight light source) is determined on the basis of, for example, the maximum value or the average value of the target luminance values (the luminance values corresponding to the input gradation values) of the pixels included in each area. Then, a process of converting the input gradation values W, R, G, and B of each pixel on the basis of the luminance of the LED in the corresponding area is performed. Converted input gradation values of white, red, green, and blue are denoted by reference letters W', R', G', and B', respectively.

Specifically, the process of converting the input gradation value is performed for the data about each pixel so as to meet the following equations (1) to (4):

$$D(W)=BLw\times D(W') \quad (1)$$

$$D(R)=BLr\times D(R') \quad (2)$$

$$D(G)=BLg\times D(G') \quad (3)$$

$$D(B)=BLb\times D(B') \quad (4)$$

In the above equations, D(x) denotes a function to convert a gradation value "x" into luminance (transmittance). BLw, BLr, BLg, and BLb denote values corresponding to the luminance values for the respective colors of white, red, green, and blue, which are standardized so that the luminance when the LED is displayed at a certain luminance (the luminance when the local dimming is not performed) is equal to one.

As apparent from the above equations (1) to (4), the conversion of the input gradation value is performed for the data about each color of each pixel so that a product of the luminance of the LED of each color and the luminance corresponding to the converted input gradation value is equal to the luminance corresponding to the input gradation value before the conversion. The pieces of data indicating the converted input gradation values are supplied to the data compensation circuit 120 as the pieces of converted input gradation data (the white converted input gradation data W', the red converted input gradation data R', the green converted input gradation data G', and the blue converted input gradation data B'). The pieces of data indicating the luminance values of the LEDs, which are acquired by the local dimming conversion circuit 140, are stored in the backlight control field memories (the backlight control white-field memory 150(W), the backlight control red-field memory 150(R), the backlight control green-field memory 150(G), and the backlight control blue-field memory 150(B)) as pieces of backlight luminance data (white backlight luminance data BLw, red backlight luminance data BLr, green backlight luminance data BLg, and blue backlight luminance data BLb, respectively).

The backlight luminance data stored in the backlight control field memories is read out by the timing controller 200. The timing controller 200 outputs the LED driver control signal S1 for controlling the operation of the LED driver 330 on the basis of the backlight luminance data.

<3.3 Advantages>

According to the present embodiment, as in the first embodiment, even when the liquid crystal state is varied during the turning on of the backlight in the color-field sequential liquid crystal display apparatus, a desired display luminance is achieved in each field. In addition, the local dimming is performed in the present embodiment. Accordingly, the color-field sequential liquid crystal display apparatus is realized, which is capable of reducing the power consumption of the backlight while suppressing an occurrence of the color shift.

4. Fourth Embodiment

<4.1 Outline>

In the third embodiment described above, in the color-field sequential liquid crystal display apparatus that performs the local dimming, one frame period is divided into the four fields including the white field, the red field, the green field, and the blue field. However, the structure of one frame period is not limited to this. A structure (structure of the present embodiment) may be adopted, in which one frame period is divided into four fields including an arbitrary color mixture field.

Figure 32:
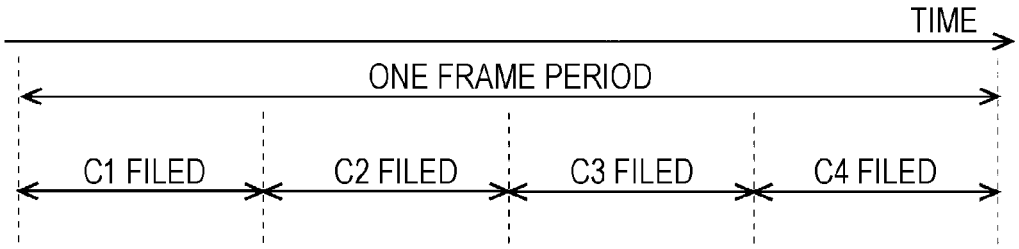
FIG. 32 illustrates the structure of one frame period in a fourth embodiment of the present invention.

FIG. 32 illustrates the structure of one frame period in the present embodiment. As described above, one frame period is divided into the four fields including an arbitrary color mixture field. Here, the first field is referred to as "a C1 field", the second field is referred to as "a C2 field", the third field is referred to as "a C3 field", and the fourth field is referred to as "a C4 field." For example, "a white screen is displayed in the C1 field, a yellow (color resulting from mixture of red and green) screen is displayed in the C2 field, a red screen is displayed in the C3 field, and a blue screen is displayed in the C4 field." As described above, the structure of one frame period in which an occurrence of the color breakup is further suppressed may be adopted.

<4.2 Configuration>

Figure 33:
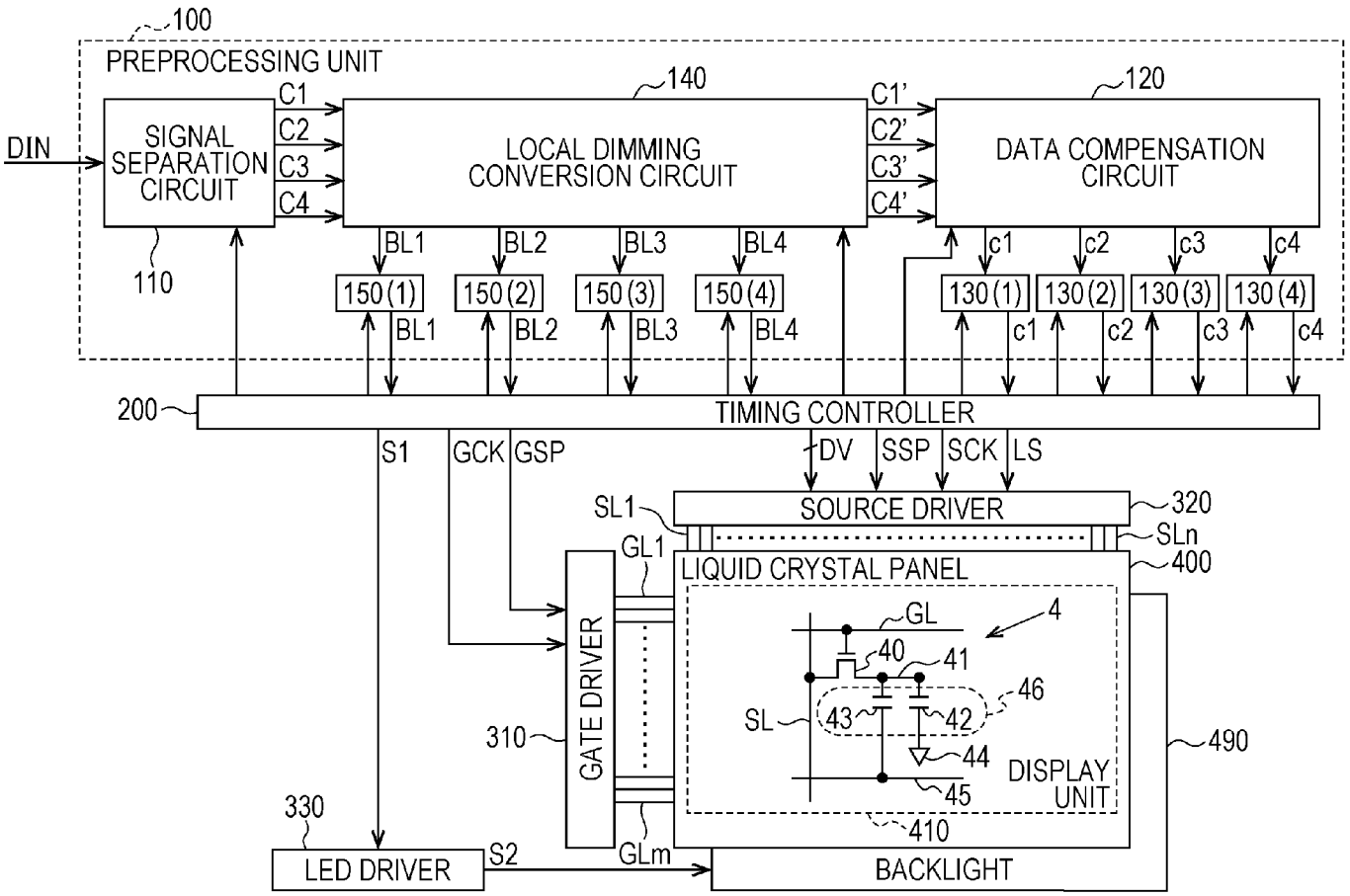
FIG. 33 is a block diagram illustrating the entire configuration of a liquid crystal display apparatus according to the fourth embodiment.
Figure 34:
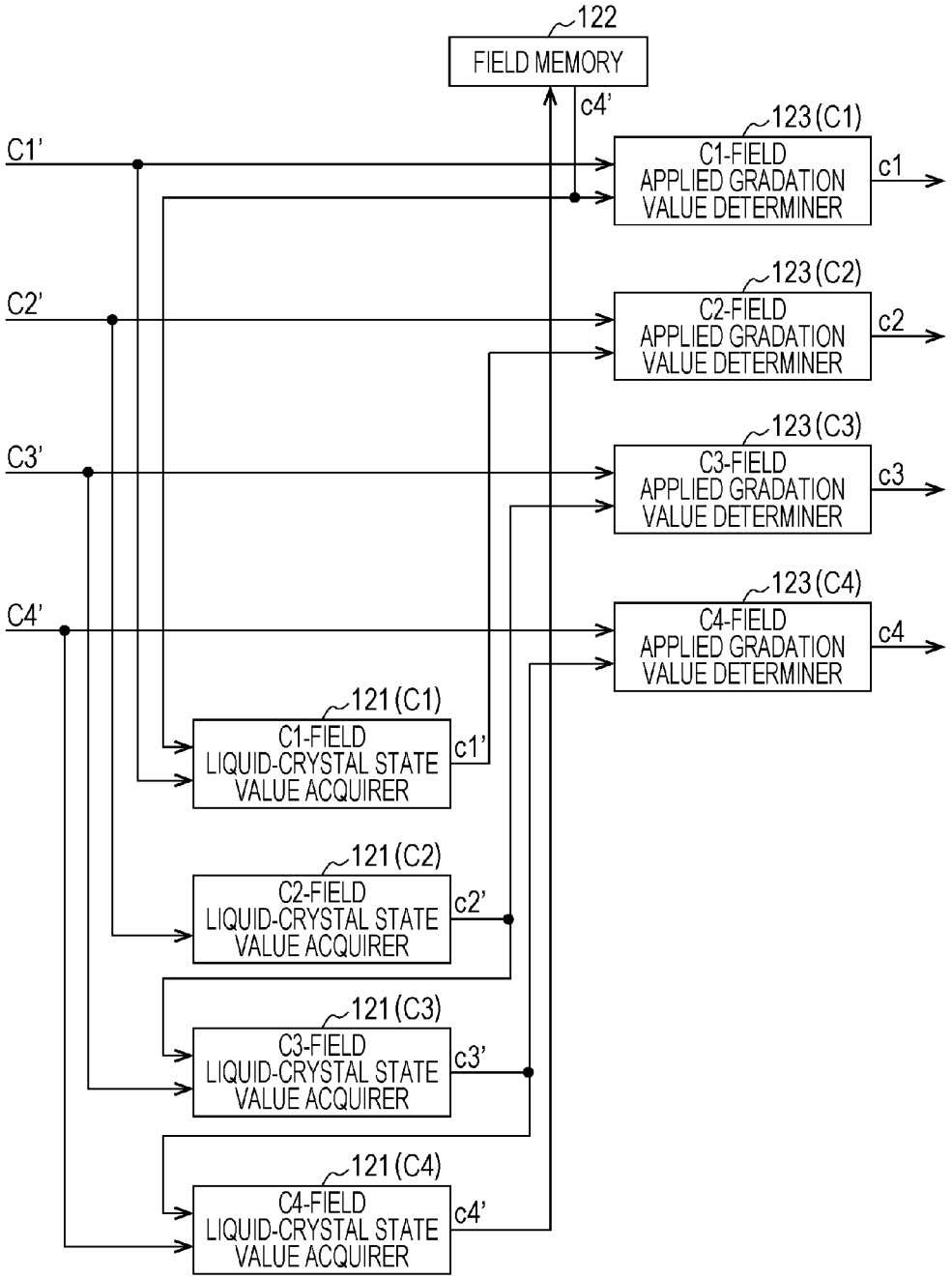
FIG. 34 is a block diagram illustrating the configuration of a data compensation circuit in the fourth embodiment.
Figure 35:
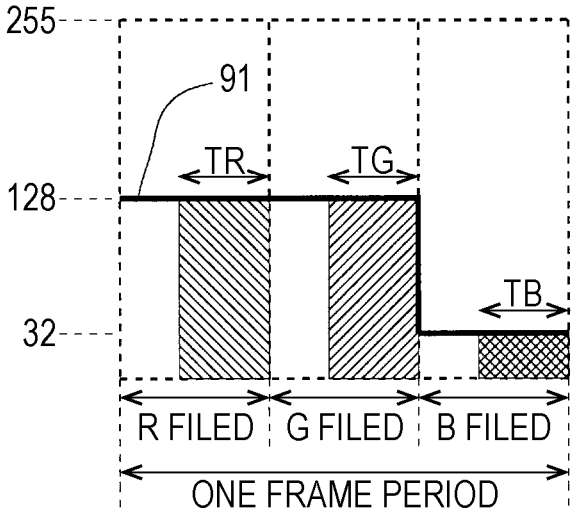
FIG. 35 is a waveform diagram illustrating an example of how the liquid crystal state is varied when liquid crystal molecules have ideal response characteristics.
Figure 36:
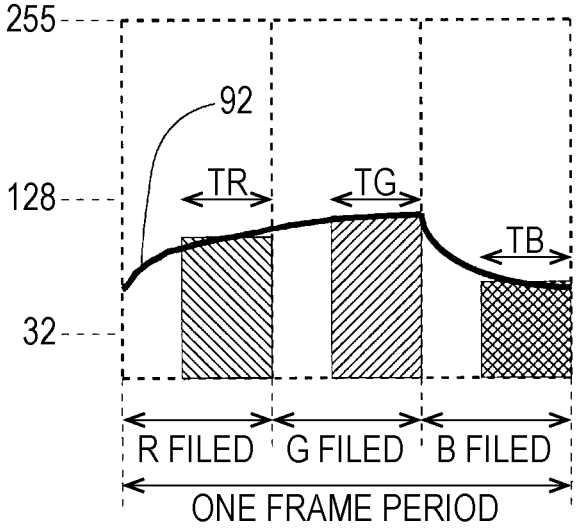
FIG. 36 is a waveform diagram illustrating an example of how the liquid crystal state is varied when the overdrive driving is not adopted.
Figure 37:
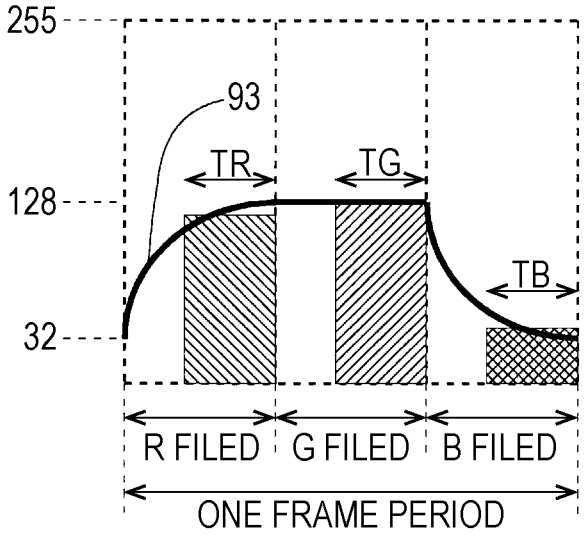
FIG. 37 is a waveform diagram illustrating an example of how the liquid crystal state is varied when the overdrive driving is adopted.

FIG. 33 is a block diagram illustrating the entire configuration of a liquid crystal display apparatus according to a fourth embodiment of the present invention. The configuration of the liquid crystal display apparatus in the present embodiment is substantially the same as the configuration of the liquid crystal display apparatus in the third embodiment described above (refer to FIG. 30). However, the colors of the four fields are different from those in the third embodiment. FIG. 34 is a block diagram illustrating the configuration of the data compensation circuit 120 in the present embodiment. The configuration of the data compensation circuit 120 in the present embodiment is substantially the same as the configuration of the data compensation circuit 120 in the second embodiment described above (FIG. 28) and the configuration of the data compensation circuit 120 in the third embodiment described above (FIG. 31). However, the colors of the four fields are different from those in the second embodiment and the third embodiment. Since the operation of each component is the same as that in the above embodiments, a description of the operation of each component is omitted herein.

In the present embodiment, an arbitrary color mixture field is included in one frame period. Consequently, it is not possible to compensate the response from the liquid crystal using a lookup table for each color. In terms of this, although the display luminance appearing in the liquid crystal panel 400 is varied with color due to wavelength dispersion (variation in refractive index depending of the wavelength), the response itself of the liquid crystal does not depend on the color. Accordingly, in the present embodiment, a common liquid-crystal state value acquisition lookup table is used in a C1-field liquid-crystal state value acquirer 121(C1), a C2-field liquid-crystal state value acquirer 121(C2), a C3-field liquid-crystal state value acquirer 121(C3), and a C4-field liquid-crystal state value acquirer 121(C4) illustrated in FIG. 34. Similarly, a common applied gradation value determination lookup table is used in a C1-field applied gradation value determiner 123(C1), a C2-field applied gradation value determiner 123(C2), a C3-field applied gradation value determiner 123(C3), and a C4-field applied gradation value determiner 123(C4) illustrated in FIG. 34. These lookup tables are created on the basis of the results of a variety measurement using the white display.

<4.3 Advantages>

According to the present embodiment, even when the liquid crystal state is varied during the turning on of the backlight 490 in the color-field sequential liquid crystal display apparatus in which one frame period is divided into the four fields including an arbitrary color mixture field, a substantially desired display luminance is achieved in each field. In addition, the local dimming is performed in the present embodiment. Accordingly, the color-field sequential liquid crystal display apparatus is realized, which is capable of suppressing an occurrence of the color breakup, reducing the power consumption of the backlight 490, and suppressing an occurrence of the color shift.

5. Others

The present invention is not limited to these specific embodiments and various modifications may be made without departing from the true spirit and scope of the present invention. For example, although one frame period is divided into the three fields in the first embodiment and one frame period is divided into the four fields in the second to fourth embodiments, the present invention is not limited to these. One frame period may be divided into five fields.

When one frame period is divided into P-number (P is an integer larger than or equal to three) fields, each component in the data compensation circuit 120 may operate in the following manner. The liquid crystal state data about the P-th field is stored in the field memory 122. The liquid-crystal state value acquirer 121 for the first field acquires the liquid-crystal state value at the end of the first field on the basis of the input gradation value of the first field of the current frame and the liquid crystal state at the end of the P-th field of the previous frame (the first previous frame of the current frame), which is stored in the field memory 122. The applied gradation value determiner 123 for the first field determines the applied gradation value of the first field by compensating the input gradation value of the first field of the current frame on the basis of the liquid-crystal state value at the end of the P-th field of the previous frame, which is stored in the field memory 122. The liquid-crystal state value acquirer 121 of a Q-th (Q is an integer larger than or equal to two and smaller than or equal to P) field acquires the liquid-crystal state value at the end of the Q-th field on the basis of the input gradation value of the Q-th field of the current frame and the liquid-crystal state value at the end of the (Q−1)-th field of the current frame. The applied gradation value determiner 123 for the Q-th field determines the applied gradation value of the Q-th field by compensating the input gradation value of the Q-th field of the current frame on the basis of the liquid-crystal state value at the end of the (Q−1)-th field of the current frame.

Although the local dimming is performed in the fourth embodiment, a configuration in which the components involved in the local dimming are removed from the configuration in the fourth embodiment may be adopted. Specifically, a configuration in which W, R, G, and B in the second embodiment are replaced with C1, C2, C3, and C4 in the fourth embodiment may be adopted.

6. Additions

Configurations described below are considered as a liquid crystal display apparatus and a method of driving the liquid crystal display apparatus according to the present invention.

(First Addition)

A color-field sequential liquid crystal display apparatus that divides one frame period into a plurality of fields and displays different colors in different fields to perform color display includes a liquid crystal panel 400 on which an image is displayed;

a backlight 490 that irradiates the liquid crystal panel 400 with light;

an input image data separation unit 110 that separates input image data into input gradation data for every field;

a data compensation unit 120 that determines applied gradation data, which corresponds to voltage to be applied to the liquid crystal panel 400, by compensating the input image data while acquiring liquid crystal state data, which corresponds to expected attained gradation at the end of each field;

a liquid crystal panel driving unit (200, 310, 320) that drives the liquid crystal panel 400 on the basis of the applied gradation data; and a backlight driving unit 330 that drives the backlight 490 so that the liquid crystal panel is irradiated with light of different colors in different fields.

The data compensation unit 120 includes a liquid-crystal state data acquirer 121 that acquires the liquid crystal state data about a current field on the basis of the input gradation data about the current field and the liquid crystal state data about a first previous field of the current field and that is provided for each field composing one frame period; and an applied gradation data determiner 123 that determines the applied gradation data about the current field by compensating the input gradation data about the current field on the basis of the liquid crystal state data about the first previous field of the current field and that is provided for each field composing one frame period.

The applied gradation data determiner 123 determines the applied gradation data so that a display luminance in each field is a display luminance corresponding to the input gradation data resulting from the separation by the input image data separation unit.

In the above configuration, the color-field sequential liquid crystal display apparatus includes the liquid-crystal state data acquirer 121, which acquires the liquid-crystal state data about the current field on the basis of the input gradation data about the current field and the liquid-crystal state data (data corresponding to expected attained gradation at the end of the previous field) about the previous field (the first previous field of the current field), and the applied gradation data determiner 123, which determines the applied gradation data about the current field by compensating the input gradation data about the current field on the basis of the liquid-crystal state data about the previous field. Accordingly, it is possible to perform the compensation to enhance the temporal change of the values of data for the input image data so that the integral value of the luminance values during the turning on of the backlight reaches a target display luminance in consideration of the change in the liquid crystal state in all the previous fields. Consequently, even when the liquid crystal state is varied during the turning on of the backlight 490, a desired display luminance is achieved in each field. As described above, the color-field sequential liquid crystal display apparatus is realized, which is capable of suppressing an occurrence of the color shift.

(Second Addition)

In the liquid crystal display apparatus described in First addition, the data compensation unit 120 includes a field memory 122 that is capable of holding data corresponding to one field, one frame period is divided into P-number fields, in which P is an integer larger than or equal to three, the liquid crystal state data about a P-th field is held in the field memory 122, the liquid-crystal state data acquirer 121 for a first field acquires the liquid crystal state data about the first field of a current frame on the basis of the input gradation data about the first field of the current frame and the liquid crystal state data about the P-th field of a previous frame, which is held in the field memory, the applied gradation data determiner 123 for the first field determines the applied gradation data about the first field of the current frame by compensating the input gradation data about the first field of the current frame on the basis of the liquid crystal state data about the P-th field of the previous frame, which is held in the field memory, the liquid-crystal state data acquirer 121 for a Q-th field, in which Q is an integer larger than or equal to two and smaller than or equal to P, acquires the liquid crystal state data about the Q-th field of the current frame on the basis of the input gradation data about the Q-th field of the current frame and the liquid crystal state data about a (Q−1)-th field of the current frame, and the applied gradation data determiner 123 for the Q-th field determines the applied gradation data about the Q-th field of the current frame by compensating the input gradation data about the Q-th field of the current frame on the basis of the liquid crystal state data about the (Q−1)-th field of the current frame.

With the above configuration, advantages similar to those of the configuration described in First addition are reliably achieved.

(Third Addition)

The liquid crystal display apparatus described in First addition further includes a data conversion unit 140 that divides the area of the liquid crystal panel into a plurality of subareas to determine a light emitting luminance of the backlight corresponding to each subarea on the basis of the input gradation data about each pixel included in each subarea and that converts the input gradation data resulting from the separation by the input image data separation unit on the basis of the light emitting luminance.

In the liquid crystal display apparatus described in First addition, converted input gradation data converted by the data conversion unit 140 is supplied to the data compensation unit 120 as the input gradation data, and the backlight driving unit 330 drives the backlight 490 so that the backlight 490 corresponding to each subarea emits light on the basis of the light emitting luminance determined by the data conversion unit 140.

With the above configuration, the liquid crystal display apparatus includes the data conversion unit 140 that performs the so-called local dimming. Accordingly, the color-field sequential liquid crystal display apparatus is realized, which is capable of reducing the power consumption of the backlight 490 while suppressing an occurrence of the color shift.

(Fourth Addition)

In the liquid crystal display apparatus described in First addition, the liquid-crystal state data acquirer 121 includes a liquid-crystal state data acquisition lookup table 1210 in which values associated with the input gradation data about the current field, values associated with the liquid crystal state data about the first previous field of the current field, and values corresponding to combinations of the values associated with the input gradation data about the current field and the values associated with the liquid crystal state data about the first previous field of the current field are stored, the liquid crystal state data about the current field is acquired on the basis of the liquid-crystal state data acquisition lookup table 1210, the applied gradation data determiner 123 includes an applied gradation data determination lookup table 1230 in which values associated with the input gradation data about the current field, values associated with the liquid crystal state data about the first previous field of the current field, and values corresponding to combinations of the values associated with the input gradation data about the current field and the values associated with the liquid crystal state data about the first previous field of the current field are stored, and the applied gradation data about the current field is acquired on the basis of the applied gradation data determination lookup table 1230.

With the above configuration, even when many kinds of the liquid crystal panels 400 exist, it is sufficient to change the values in the lookup tables (the liquid-crystal state data acquisition lookup table 1210 and the applied gradation data determination lookup table 1230) depending on response characteristics of each liquid crystal panel 400.

(Fifth Addition)

In the liquid crystal display apparatus described in First addition, one frame period is divided into three fields including a red field in which a red screen is displayed, a green field in which a green screen is displayed, and a blue field in which a blue screen is displayed.

With the above configuration, advantages similar to those of the configuration described in First addition are achieved in the color-field sequential liquid crystal display apparatus adopting the common configuration of one frame period.

(Sixth Addition)

In the liquid crystal display apparatus described in First addition, one frame period is divided into four fields including a white field in which a white screen is displayed, a red field in which a red screen is displayed, a green field in which a green screen is displayed, and a blue field in which a blue screen is displayed.

In the above configuration, one frame period is composed of the white field, the red field, the green field, and the blue field. In other words, one frame period includes a field for display of a color mixture component of at least two colors of the three primary colors, in addition to the three fields. In each of the three fields, the single color display of each color in the three primary colors is performed. Accordingly, an occurrence of the color breakup is suppressed. As described above, the color-field sequential liquid crystal display apparatus is realized, which is capable of suppressing an occurrence of the color breakup and suppressing an occurrence of the color shift.

(Seventh Addition)

In the liquid crystal display apparatus described in First addition, one frame period is divided into at least three fields each capable of display of a mixed color screen, and screens of different colors are displayed in the at least three fields.

In the above configuration, one frame period is composed of at least three fields each capable of display of a mixed color screen. Accordingly, as in the configuration described in Sixth addition, the color-field sequential liquid crystal display apparatus is realized, which is capable of suppressing an occurrence of the color breakup and suppressing an occurrence of the color shift.

(Eighth Addition)

In the liquid crystal display apparatus described in First addition, the liquid crystal panel 400 includes a pixel electrode 41 arranged in a matrix pattern;

a common electrode 44 arranged so as to be opposed to the pixel electrode 41;

a liquid crystal 42 sandwiched between the pixel electrode 41 and the common electrode 44;

a scanning signal line GL;

a video signal line SL to which a video signal corresponding to the applied gradation data is applied; and a thin film transistor 40 a control terminal of which is connected to the scanning signal line GL, a first conductive terminal of which is connected to the video signal line SL, a second conductive terminal of which is connected to the pixel electrode 41, and a channel layer of which is formed of oxide semiconductor.

In the color-field sequential liquid crystal display apparatus having the above configuration, the thin film transistor the channel layer of which is formed of oxide semiconductor is used as the thin film transistor 40 provided in the liquid crystal panel 400. Accordingly, the writing speed is increased, compared with that in the related art, in addition to achievement of the advantages of increase in fineness and reduction in power consumption. As a result, an occurrence of the color shift is more effectively suppressed.

(Ninth Addition)

In the liquid crystal display apparatus described in Eighth addition, the oxide semiconductor contains indium (In), gallium (Ga), zinc (Zn), and oxygen (O) as major components.

With the above configuration, use of indium gallium zinc oxide as the oxide semiconductor forming the channel layer reliably achieves advantages similar to those of the configuration described in Eighth addition.

(Tenth Addition)

A method of driving a color-field sequential liquid crystal display apparatus that includes a liquid crystal panel 400 on which an image is displayed and a backlight 490 that irradiates the liquid crystal panel 400 with light and that divides one frame period into a plurality of fields and displays different colors in different fields to perform color display includes an input image data separating step of separating input image data into input gradation data for every field;

a data compensating step of determining applied gradation data, which corresponds to voltage to be applied to the liquid crystal panel, by compensating the input image data while acquiring liquid crystal state data, which corresponds to expected attained gradation at the end of each field;

a liquid crystal panel driving step of driving the liquid crystal panel 400 on the basis of the applied gradation data; and a backlight driving step of driving the backlight 490 so that the liquid crystal panel 400 is irradiated with light of different colors in different fields.

The data compensating step includes a liquid-crystal state data acquiring step of acquiring the liquid crystal state data about a current field on the basis of the input gradation data about the current field and the liquid crystal state data about a first previous field of the current field; and an applied gradation data determining step of determining the applied gradation data about the current field by compensating the input gradation data about the current field on the basis of the liquid crystal state data about the first previous field of the current field.

The applied gradation data determining step determines the applied gradation data so that a display luminance in each field is a display luminance corresponding to the input gradation data acquired in the input image data separating step.

With the above configuration, advantages similar to those of the configuration described in First addition are achieved in the method of driving the color-field sequential liquid crystal display apparatus.

REFERENCE SIGNS LIST

100 preprocessing unit
110 signal separation circuit
120 data compensation circuit
121(R) red-field liquid-crystal state value acquirer
121(G) green-field liquid-crystal state value acquirer
121(B) blue-field liquid-crystal state value acquirer
121(C1) to 121(C4) C1 to C4-field liquid-crystal state value acquirers
122 field memory
123(R) red-field applied gradation value determiner
123(G) green-field applied gradation value determiner
123(B) blue-field applied gradation value determiner
123(C1) to 123(C4) C1 to C4-field applied gradation value determiners
140 local dimming conversion circuit
200 timing controller
310 gate driver
320 source driver
330 LED driver
400 liquid crystal panel
410 display unit
490 backlight
1210 liquid-crystal state value acquisition lookup table
1230 applied gradation value determination lookup table

The invention claimed is:

1. A color-field sequential liquid crystal display apparatus that divides one frame period into a plurality of fields and displays different colors in different fields to perform color display, the liquid crystal display apparatus comprising:

a liquid crystal panel on which an image is displayed;

a backlight that irradiates the liquid crystal panel with light;

an input image data separation unit that separates input image data into input gradation data for every field;

a data compensation unit that determines applied gradation data, which corresponds to voltage to be applied to the liquid crystal panel, by compensating the input image data while acquiring liquid crystal state data, which corresponds to expected attained gradation at the end of each field;

a liquid crystal panel driving unit that drives the liquid crystal panel on the basis of the applied gradation data; and a backlight driving unit that drives the backlight so that the liquid crystal panel is irradiated with light of different colors in different fields, wherein the data compensation unit includes a liquid-crystal state data acquirer that acquires the liquid crystal state data about a current field on the basis of the input gradation data about the current field and the liquid crystal state data about a first previous field of the current field and that is provided for each field composing one frame period; and an applied gradation data determiner that determines the applied gradation data about the current field by compensating the input gradation data about the current field on the basis of the liquid crystal state data about the first previous field of the current field and that is provided for each field composing one frame period, and wherein the applied gradation data determiner determines the applied gradation data so that a display luminance in each field is a display luminance corresponding to the input gradation data resulting from the separation by the input image data separation unit, and wherein a provision of the liquid-crystal state data acquirer and the applied gradation data determiner for every field composing one frame period allows the applied gradation data about an arbitrary displayed field to be determined by acquiring the liquid crystal state data about a first previous field of the displayed field on the basis of the input gradation data about the first previous field of the displayed field and the liquid crystal state data about a second previous field of the displayed field and compensating the input gradation data about the displayed field on the basis of the acquired liquid crystal state data.

2. The liquid crystal display apparatus according to claim 1, wherein the data compensation unit includes a field memory that is capable of holding data corresponding to one field, wherein one frame period is divided into P-number fields, P being an integer larger than or equal to three, wherein the liquid crystal state data about a P-th field is held in the field memory, wherein the liquid-crystal state data acquirer for a first field acquires the liquid crystal state data about the first field of a current frame on the basis of the input gradation data about the first field of the current frame and the liquid crystal state data about the P-th field of a previous frame, which is held in the field memory, wherein the applied gradation data determiner for the first field determines the applied gradation data about the first field of the current frame by compensating the input gradation data about the first field of the current frame on the basis of the liquid crystal state data about the P-th field of the previous frame, which is held in the field memory, wherein the liquid-crystal state data acquirer for a Q-th field, Q being an integer larger than or equal to two and smaller than or equal to P, acquires the liquid crystal state data about the Q-th field of the current frame on the basis of the input gradation data about the Q-th field of the current frame and the liquid crystal state data about a (Q−1)-th field of the current frame, and wherein the applied gradation data determiner for the Q-th field determines the applied gradation data about the Q-th field of the current frame by compensating the input gradation data about the Q-th field of the current frame on the basis of the liquid crystal state data about the (Q−1)-th field of the current frame.

3. The liquid crystal display apparatus according to claim 1, further comprising:

a data conversion unit that divides the area of the liquid crystal panel into a plurality of subareas to determine a light emitting luminance of the backlight corresponding to each subarea on the basis of the input gradation data about each pixel included in each subarea and that converts the input gradation data resulting from the separation by the input image data separation unit on the basis of the light emitting luminance, wherein converted input gradation data converted by the data conversion unit is supplied to the data compensation unit as the input gradation data, and wherein the backlight driving unit drives the backlight so that the backlight corresponding to each subarea emits light on the basis of the light emitting luminance determined by the data compensation unit.

4. The liquid crystal display apparatus according to claim 1, wherein the liquid-crystal state data acquirer includes a liquid-crystal state data acquisition lookup table in which values associated with the input gradation data about the current field, values associated with the liquid crystal state data about the first previous field of the current field, and values corresponding to combinations of the values associated with the input gradation data about the current field and the values associated with the liquid crystal state data about the first previous field of the current field are stored, wherein the liquid crystal state data about the current field is acquired on the basis of the liquid-crystal state data acquisition lookup table, wherein the applied gradation data determiner includes an applied gradation data determination lookup table in which values associated with the input gradation data about the current field, values associated with the liquid crystal state data about the first previous field of the current field, and values corresponding to combinations of the values associated with the input gradation data about the current field and the values associated with the liquid crystal state data about the first previous field of the current field are stored, and wherein the applied gradation data about the current field is acquired on the basis of the applied gradation data determination lookup table.

5. A method of driving a color-field sequential liquid crystal display apparatus that includes a liquid crystal panel on which an image is displayed and a backlight that irradiates the liquid crystal panel with light and that divides one frame period into a plurality of fields and displays different colors in different fields to perform color display, the method comprising:

an input image data separating step of separating input image data into input gradation data for every field;

a data compensating step of determining applied gradation data, which corresponds to voltage to be applied to the liquid crystal panel, by compensating the input image data while acquiring liquid crystal state data, which corresponds to expected attained gradation at the end of each field;

a liquid crystal panel driving step of driving the liquid crystal panel on the basis of the applied gradation data; and a backlight driving step of driving the backlight so that the liquid crystal panel is irradiated with light of different colors in different fields, wherein the data compensating step includes a liquid-crystal state data acquiring step of acquiring the liquid crystal state data about a current field on the basis of the input gradation data about the current field and the liquid crystal state data about a first previous field of the current field; and an applied gradation data determining step of determining the applied gradation data about the current field by compensating the input gradation data about the current field on the basis of the liquid crystal state data about the first previous field of the current field, and wherein the applied gradation data determining step determines the applied gradation data so that a display luminance in each field is a display luminance corresponding to the input gradation data acquired in the input image data separating step, and wherein the applied gradation data about an arbitrary displayed field is determined by acquiring the liquid crystal state data about a first previous field of the displayed field on the basis of the input gradation data about the first previous field of the displayed field and the liquid crystal state data about a second previous field of the displayed field and compensating the input gradation data about the displayed field on the basis of the acquired liquid crystal state data.

6. The liquid crystal display apparatus according to claim 1, wherein one frame period is divided into three fields including a red field in which a red screen is displayed, a green field in which a green screen is displayed, and a blue field in which a blue screen is displayed.

7. The liquid crystal display apparatus according to claim 1, wherein one frame period is divided into four fields including a white field in which a white screen is displayed, a red field in which a red screen is displayed, a green field in which a green screen is displayed, and a blue field in which a blue screen is displayed.

8. The liquid crystal display apparatus according to claim 1, wherein one frame period is divided into at least three fields each capable of display of a mixed color screen, and wherein screens of different colors are displayed in the at least three fields.

9. The liquid crystal display apparatus according to claim 1, wherein the liquid crystal panel includes a pixel electrode arranged in a matrix pattern;

a common electrode arranged so as to be opposed to the pixel electrode;

a liquid crystal sandwiched between the pixel electrode and the common electrode;

a scanning signal line;

a video signal line to which a video signal corresponding to the applied gradation data is applied; and a thin film transistor a control terminal of which is connected to the scanning signal line, a first conductive terminal of which is connected to the video signal line, a second conductive terminal of which is connected to the pixel electrode, and a channel layer of which is formed of oxide semiconductor.

10. The liquid crystal display apparatus according to claim 9, wherein the oxide semiconductor contains indium (In), gallium (Ga), zinc (Zn), and oxygen (O) as major components.

* * * * *